US007070464B2

(12) United States Patent
Clark et al.

(10) Patent No.: US 7,070,464 B2
(45) Date of Patent: Jul. 4, 2006

(54) POWER CONNECTOR

(75) Inventors: Stephen L. Clark, Dillsburg, PA (US); Joseph B. Shuey, Camp Hill, PA (US); Jose L. Ortega, Camp Hill, PA (US); John B. Brown, III, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/886,550

(22) Filed: Jun. 21, 2001

(65) Prior Publication Data

US 2002/0034889 A1 Mar. 21, 2002

Related U.S. Application Data

(63) Continuation of application No. 09/160,900, filed on Sep. 25, 1998, now Pat. No. 6,319,075.

(60) Provisional application No. 60/082,091, filed on Apr. 17, 1998.

(51) Int. Cl.
*H01R 13/05* (2006.01)

(52) U.S. Cl. ..... 439/825; 439/65; 439/78

(58) Field of Classification Search ..... 439/79, 439/692, 825–827, 947, 947.2, 595
See application file for complete search history.

(56) References Cited

U.S. PATENT DOCUMENTS

| | | | | |
|---|---|---|---|---|
| 3,497,850 | A | 2/1970 | Gallo, Sr. | 337/197 |
| 3,750,092 | A | 7/1973 | Bury | |
| 3,789,348 | A | 1/1974 | Lenaerts et al. | |
| 3,910,671 | A | 10/1975 | Townsend | |
| 3,944,312 | A | 3/1976 | Koenig | |
| 4,005,923 | A | 2/1977 | Davis, Jr. | 339/157 |
| 4,073,564 | A | 2/1978 | Davis, Jr. | 339/157 |
| 4,227,762 | A | 10/1980 | Scheiner | |
| 4,500,160 | A | 2/1985 | Bertsch | 339/166 |
| 4,626,637 | A | 12/1986 | Olsson et al. | 200/284 |
| 4,659,158 | A | 4/1987 | Sakamoto et al. | |
| 4,669,801 | A | 6/1987 | Worth | 439/404 |
| 4,685,886 | A | 8/1987 | Denlinger et al. | 439/55 |
| 4,709,976 | A | 12/1987 | Nakama et al. | 439/350 |
| 4,780,088 | A | 10/1988 | Means | 439/107 |

(Continued)

FOREIGN PATENT DOCUMENTS

| | | |
|---|---|---|
| DE | 23 50 834 | 4/1975 |

(Continued)

*Primary Examiner*—Hien Vu
(74) *Attorney, Agent, or Firm*—Woodcock Washburn LLP

(57) ABSTRACT

A pair of mating connectors includes a receptacle having an insulative housing and at least one conductive receptacle contact with a pair of spaced walls forming a plug contact receiving space. The plug connector has an insulative housing and at least one conductive contact having a pair of spaced walls which converge to form a projection engageable in the plug receiving space of the receptacle contact. In each case, the spaced walls are joined by a bridging structure that unites the walls. The plug and receptacle contacts are retained in the respective housings by engagement of opposed lateral edge portions of the contacts with the housings in a manner to enhance heat dissipation by convection by maintaining substantial portions of the contacts spaced from the housing walls and from each other. The bridging structure may include a retention element for engaging respective connector housings to retain the contact in the housings. The open structure of both the receptacle and plug contacts enhances heat dissipation and allows flexibility in achieving desired contact normal forces. The contact construction is especially useful for electronic power connectors.

5 Claims, 22 Drawing Sheets

U.S. PATENT DOCUMENTS 4,790,763 A 12/1988 Weber et al. ..... 439/65
4,790,764 A 12/1988 Kawagnechi et al. ..... 439/78
4,820,169 A 4/1989 Weber et al. ..... 439/65
4,838,809 A 6/1989 Mouissie ..... 439/155
4,845,592 A 7/1989 Himes, Jr. et al. ..... 361/407
4,875,865 A 10/1989 Demler et al. ..... 439/101
4,881,905 A 11/1989 Demler et al. ..... 439/79
4,900,271 A 2/1990 Colleran et al. ..... 439/595
4,917,625 A 4/1990 Haile ..... 439/358
4,941,830 A 7/1990 Tkazyik et al. ..... 439/59
4,950,186 A 8/1990 Kaley et al. ..... 439/882
4,954,090 A 9/1990 Shimochi ..... 439/76
4,968,263 A 11/1990 Silbernagel et al. ..... 439/246
5,107,328 A 4/1992 Kinsman ..... 357/74
5,108,301 A 4/1992 Torok ..... 439/263
5,133,679 A * 7/1992 Fusselman et al. ..... 439/608
5,139,426 A 8/1992 Barkus ..... 439/65
5,152,700 A 10/1992 Boguresky et al. ..... 439/733
5,158,471 A 10/1992 Fedder et al. ..... 439/80
5,207,591 A 5/1993 Ozaki et al. ..... 439/212
5,240,434 A * 8/1993 Yagi et al. ..... 439/595
5,281,168 A 1/1994 McCleerey et al. ..... 439/510
5,295,843 A 3/1994 Davis et al. ..... 439/108
5,342,219 A * 8/1994 Onodera et al. ..... 439/595
5,358,422 A 10/1994 Schaffer et al. ..... 439/346
5,362,249 A 11/1994 Carter ..... 439/357
5,376,012 A 12/1994 Clark et al. ..... 439/80
5,403,206 A 4/1995 McNamara et al. ..... 439/608
5,435,876 A 7/1995 Alfaro et al. ..... 156/247
5,458,426 A * 10/1995 Ito ..... 403/274
5,549,480 A 8/1996 Cheng ..... 439/79
5,582,519 A 12/1996 Buchter ..... 439/101
5,590,463 A 1/1997 Feldman et al. ..... 29/844
5,605,476 A 2/1997 McNamara et al. ..... 439/608
5,605,489 A 2/1997 Gale et al. ..... 451/28
5,618,187 A 4/1997 Goto ..... 439/79
5,622,511 A 4/1997 Jarrett ..... 439/248
5,643,013 A 7/1997 Weidler et al. ..... 439/660
5,667,392 A 9/1997 Kocher et al. ..... 439/79
5,702,257 A * 12/1997 Millhimes ..... 439/79
5,716,234 A 2/1998 Phillips ..... 439/595
5,743,765 A * 4/1998 Andrews et al. ..... 439/608
5,785,537 A * 7/1998 Donahue et al. ..... 439/79
5,785,557 A 7/1998 Davis ..... 439/660
5,857,876 A * 1/1999 Hatagishi ..... 439/752
5,865,651 A 2/1999 Dague et al. ..... 439/680
5,872,046 A 2/1999 Kaeriyama et al. ..... 438/465
5,904,594 A 5/1999 Longueville et al. ..... 439/608
5,923,995 A 7/1999 Kao et al. ..... 438/460
5,924,899 A 7/1999 Paagman ..... 439/701
5,937,140 A 8/1999 Leonard et al. ..... 392/392
6,027,360 A 2/2000 Jenkins ..... 439/364
6,062,911 A 5/2000 Davis et al. ..... 439/630
6,063,696 A 5/2000 Brenner et al. ..... 438/465
6,178,106 B1 1/2001 Umemoto et al. ..... 363/146
6,190,215 B1 2/2001 Pendleton et al. ..... 439/853
6,319,075 B1 11/2001 Clark et al. ..... 439/825
6,335,224 B1 1/2002 Peterson et al. ..... 438/114
6,358,094 B1 3/2002 Belopolsky et al. ..... 439/637
6,394,818 B1 5/2002 Smalley, Jr. ..... 439/79

FOREIGN PATENT DOCUMENTS

DE 34 41 416 A1 5/1986
DE 40 01 104 A1 7/1991
EP 0465013 1/1992
EP 0724313 7/1996
EP 0 951 102 A2 10/1999
FR 2 699 744 6/1994
GB 2168550 6/1986
JP 09055245 2/1997

* cited by examiner

POWER CONNECTOR

RELATED APPLICATION

This application is a continuation of U.S. application Ser. No. 09/160,900, filed Sep. 25, 1998, now U.S. Pat. No. 6,319,075, which claims the benefit of U.S. provisional application No. 60/082,091, filed Apr. 17, 1998, all of which are incorporated herein by reference.

BACKGROUND OF THE INVENTION

1. Field of the Invention

The present invention relates to electrical connectors and more particularly to electronic power connectors especially, useful in circuit board or backplane interconnection systems.

2. Brief Description of Prior Developments

Designers of electronic circuits generally are concerned with two basic circuit portions, the logic or signal portion and the power portion. In designing logic circuits, the designer usually does not have to take into account any changes in electrical properties, such as resistance of circuit components, that are brought about by changes in conditions, such as temperature, because current flows in logic circuits are usually relatively low. However, power circuits can undergo changes in electrical properties because of the relatively high current flows, for example, on the order of 30 amps or more in certain electronic equipment. Consequently, connectors designed for use in power circuits must be capable of dissipating heat (generated primarily as a result of the Joule effect) so that changes in circuit characteristics as a result of changing current flow are minimized. Conventional plug contacts in circuit board electrical power connectors are generally of rectangular (blade-like) or circular (pin-like) cross-section. These are so-called "singular-mass" designs. In these conventional singular-mass blade and pin configurations, the opposing receptacle contacts comprise a pair of inwardly urged cantilever beams and the mating blade or pin is located between the pair of beams. Such arrangements are difficult to reduce in size without adversely effecting heat dissipation capabilities. They also provide only minimal flexibility to change contact normal-forces by adjustment of contact geometry.

There is a need for a small contact which efficiently dissipates heat and which has readily modifiable contact normal forces.

SUMMARY OF THE INVENTION

The present invention relates to electrical connectors that comprises a receptacle having an insulative housing and at least one conductive receptacle contact comprising a pair of spaced walls forming a plug contact receiving space. A mating plug comprises an insulative housing and at least one conductive contact having a pair of spaced walls which form a projection engageable in the plug receiving space of the receptacle contact. The contacts employ a "dual mass" principle that provides a greater surface area available for heat dissipation, principally by convection, as compared with "single-mass" contacts. This arrangement provides an air flow path through spaced portions of the contacts of the plug and receptacle connectors when mated.

BRIEF DESCRIPTION OF THE DRAWINGS

The present invention is further described with reference to the accompanying drawings in which.

DETAILED DESCRIPTION OF THE PREFERRED EMBODIMENTS

Figure 1:
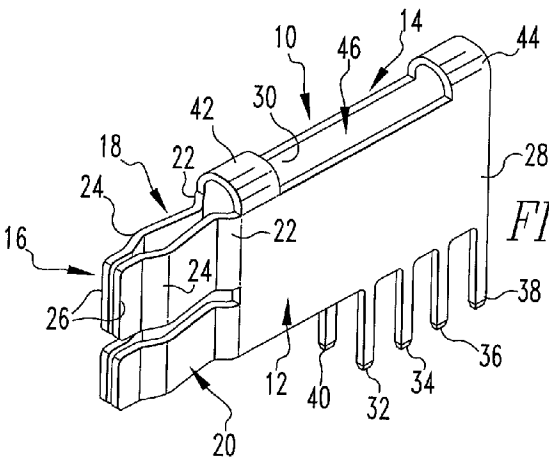
FIG. 1 is a perspective view of a plug contact.
Figure 2:
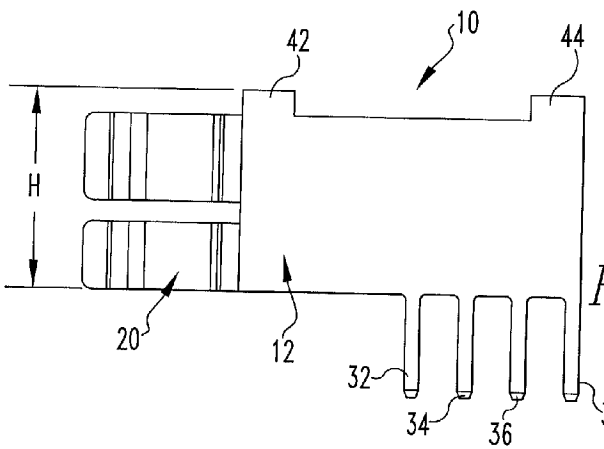
FIG. 2 is a side elevational view of the plug contact shown in FIG. 1.

Referring to FIGS. 1 and 2, a plug contact 10 for use in a plug connector is shown. This plug contact has two opposed major side walls 12 and 14. A front projection, identified generally by numeral 16, has an upper section 18 and a lower section 20. Each of these upper and lower sections comprises a pair of opposed cantilever beams, each beam having inwardly converging proximal section 22, arcuate contact section 24 and a distal section 26. The opposed distal sections 26 are preferably parallel to each other. The distal sections can be positioned slightly apart when the beams are in relaxed condition, but come together when the beams are deflected as the front projection is inserted into a receptacle contact (as explained below). This provides over-stress protection for the beams during mating. The side walls also include planar panels 28 and 30. Terminals 32, 34, 36 and 38 extend from an edge of panel 28. Terminal 40 extends from panel 30, along with a plurality of like terminals (not shown). Terminals 32–40 can comprise through hole, solder-to-board pins (as shown), press fit pins or surface mount tails. The panels 28 and 30 are connected by upper arcuate bridging elements 42 and 44. A medial space 46, adapted for air flow, is defined between the panels 28 and 30. The contact 10 is stamped or otherwise formed as a single piece from a strip of suitable contact materials such as phosphor bronze alloys or beryllium copper alloys.

Figure 3:
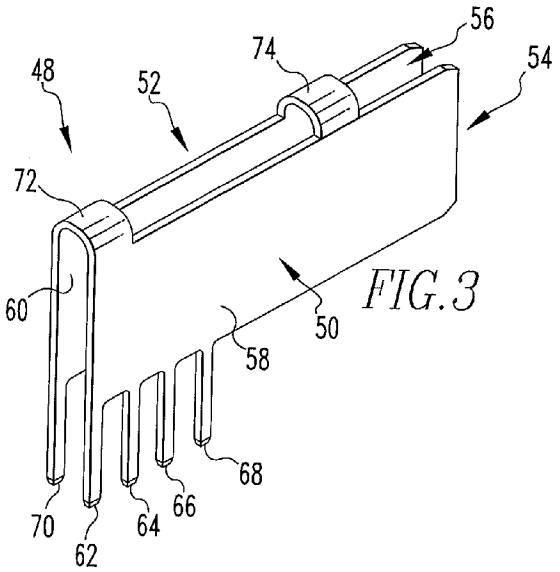
FIG. 3 is a perspective view of a receptacle contact.
Figure 4:
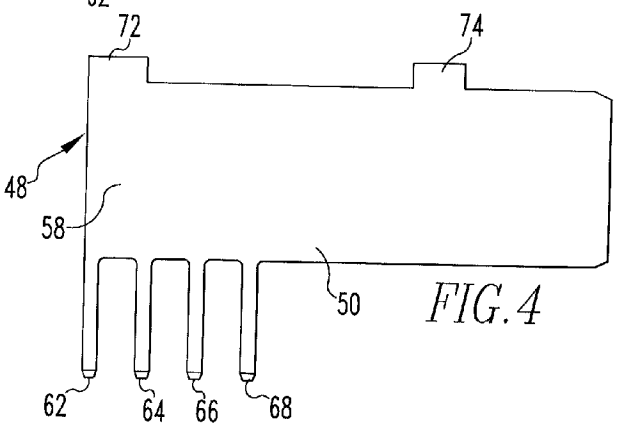
FIG. 4 is a side elevational view of the receptacle contact shown in FIG. 3.
Figure 7:
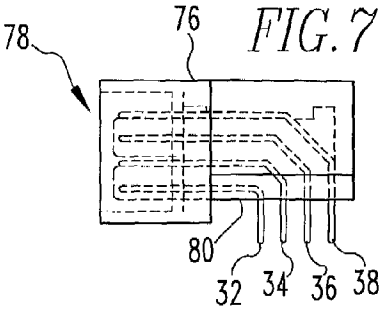
FIG. 7 is an end view of the plug connector shown in FIG. 5.
Figure 5:
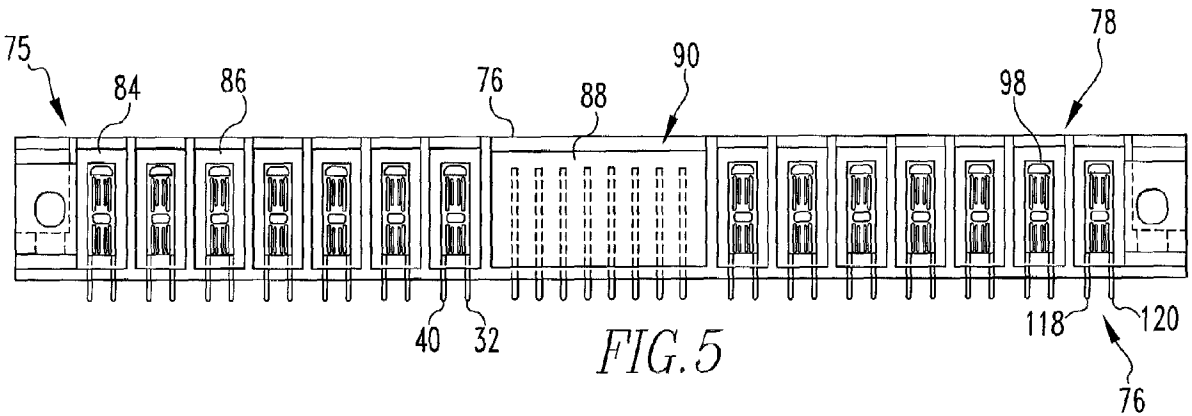
FIG. 5 is a front elevational view of a plug connector.
Figure 6:
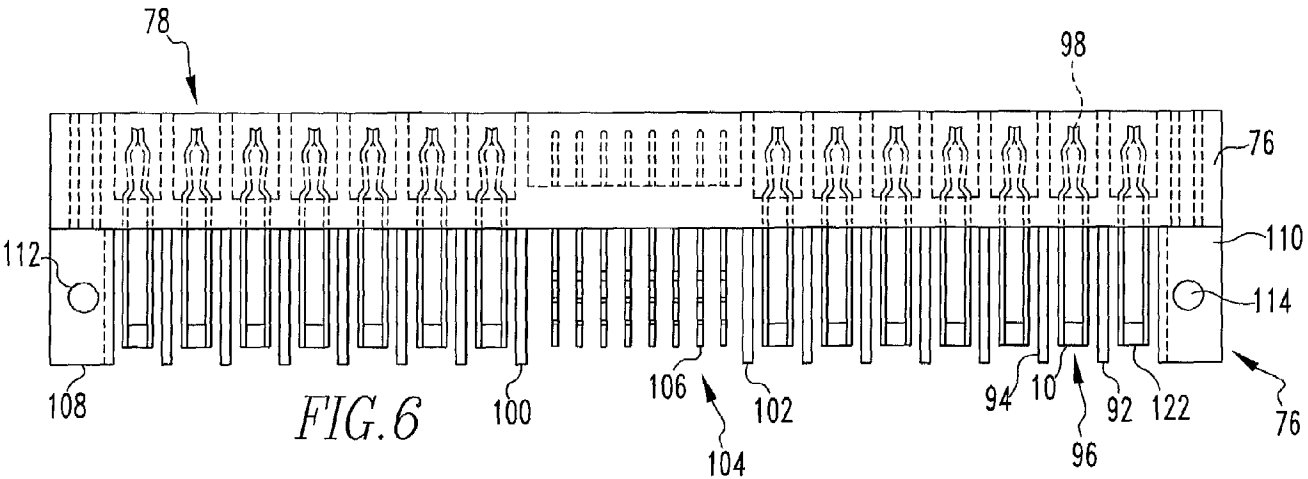
FIG. 6 is a top plan view of the plug connector shown in FIG. 5.
Figure 8:
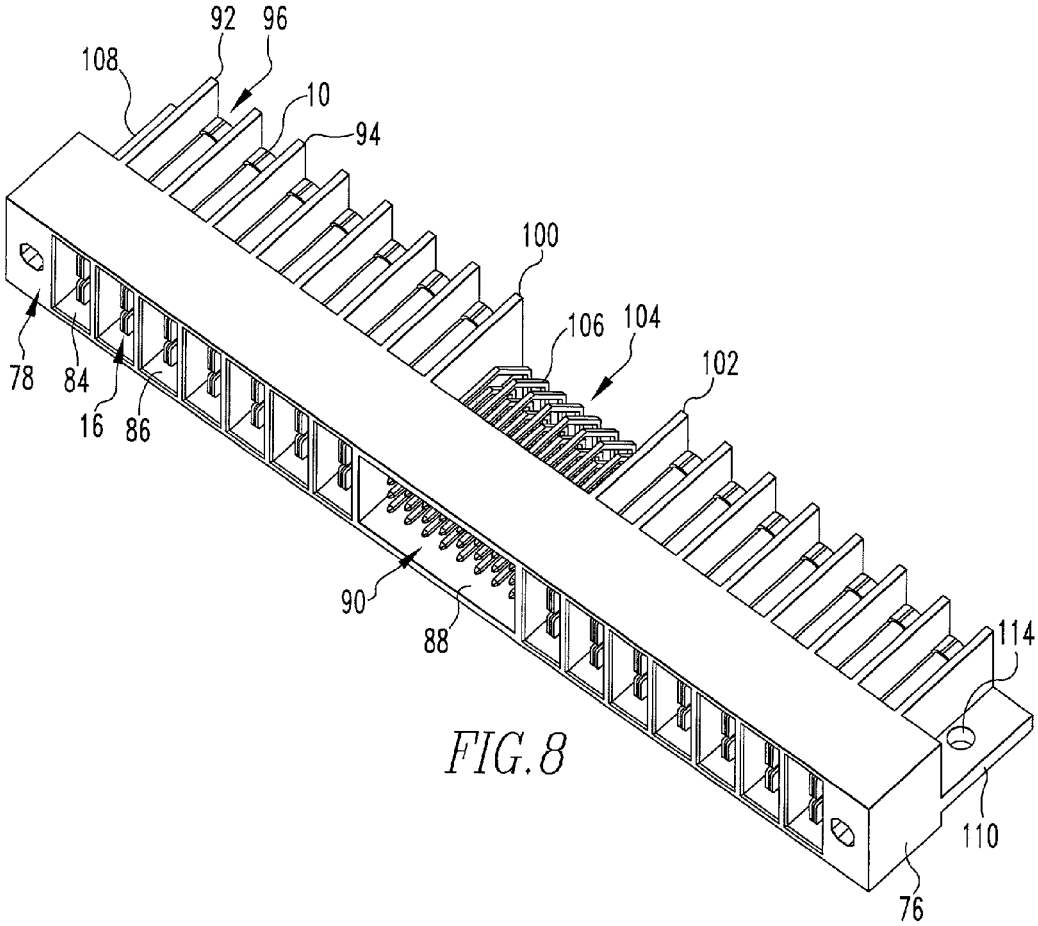
FIG. 8 is a top front perspective view of the plug connector shown in FIG. 5.
Figure 9:
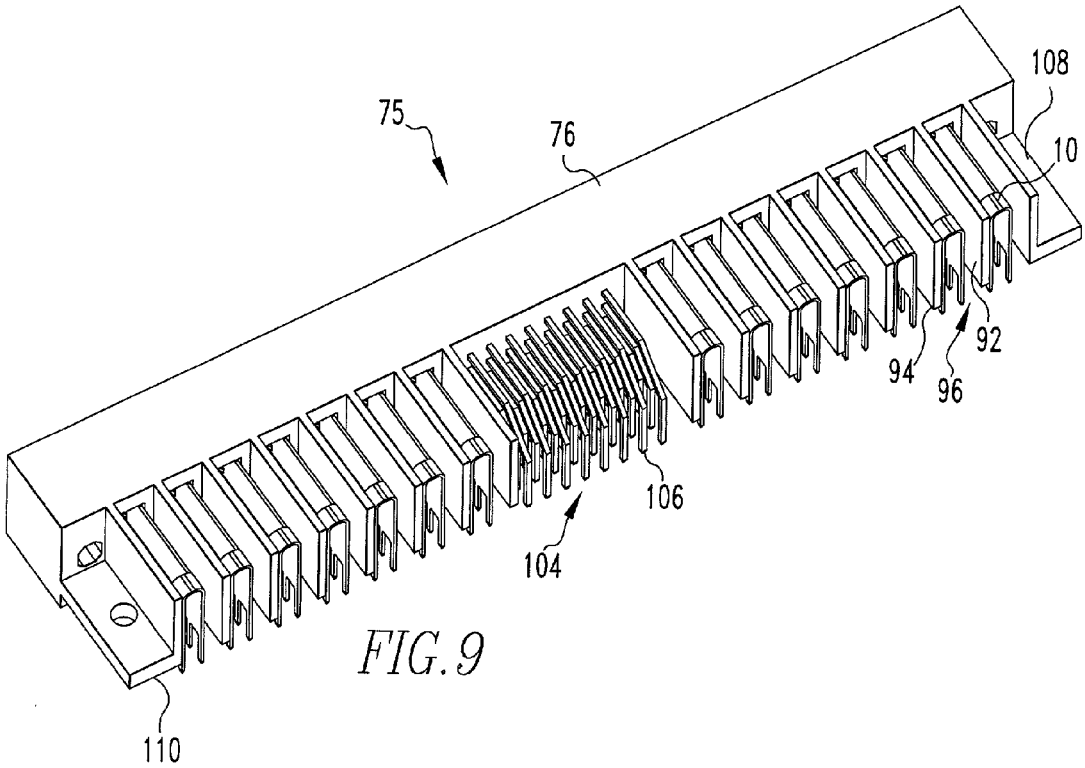
FIG. 9 is a top rear perspective view of the plug connector shown in FIG. 5.
Figure 12:
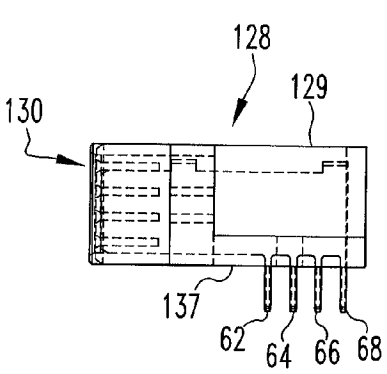
FIG. 12 is an end view of the receptacle connector shown in FIG. 10.
Figure 10:
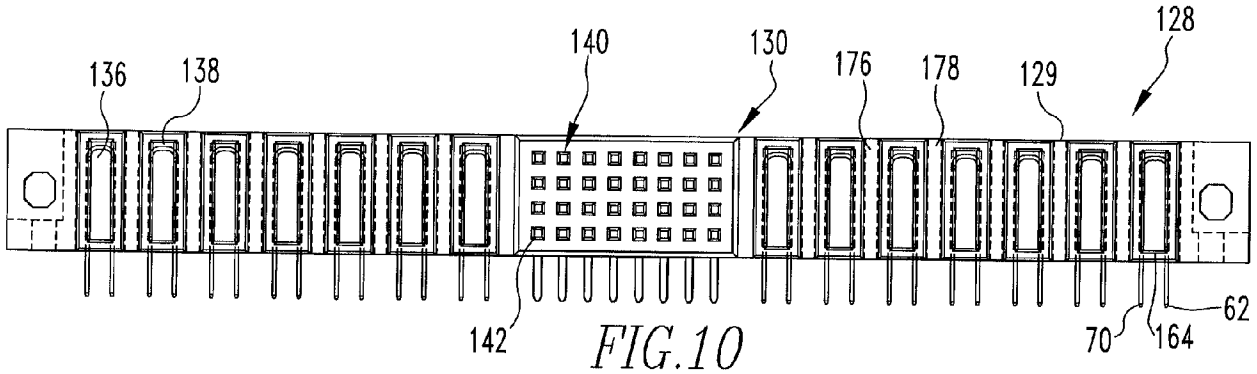
FIG. 10 is a front elevational view of a receptacle connector.
Figure 11:
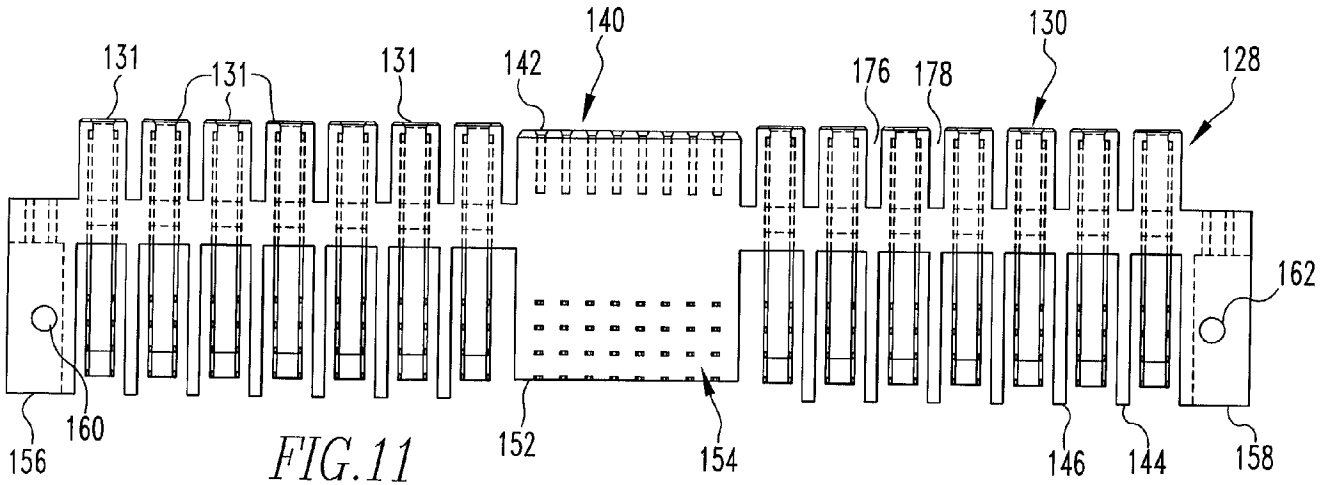
FIG. 11 is a top plan view of the receptacle connector shown in FIG. 10.
Figure 13:
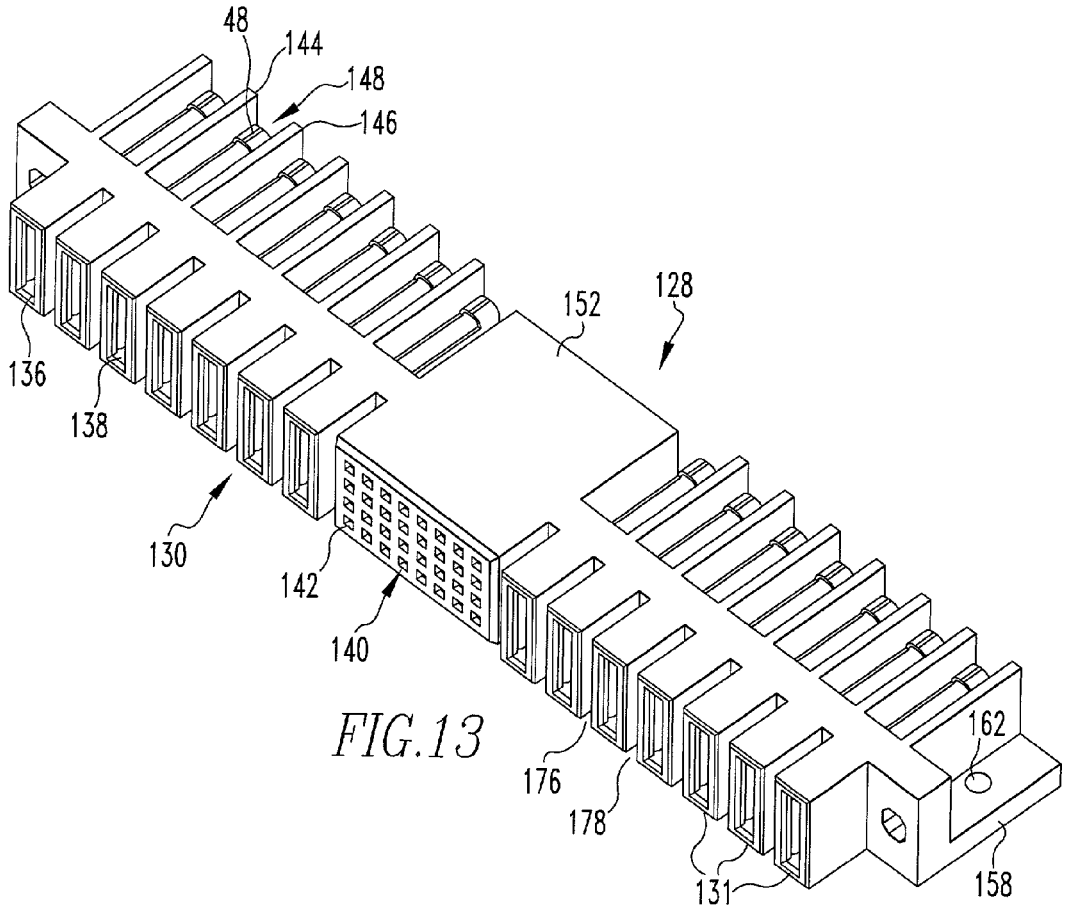
FIG. 13 is a top front respective view of the receptacle connector shown in FIG. 10.
Figure 14:
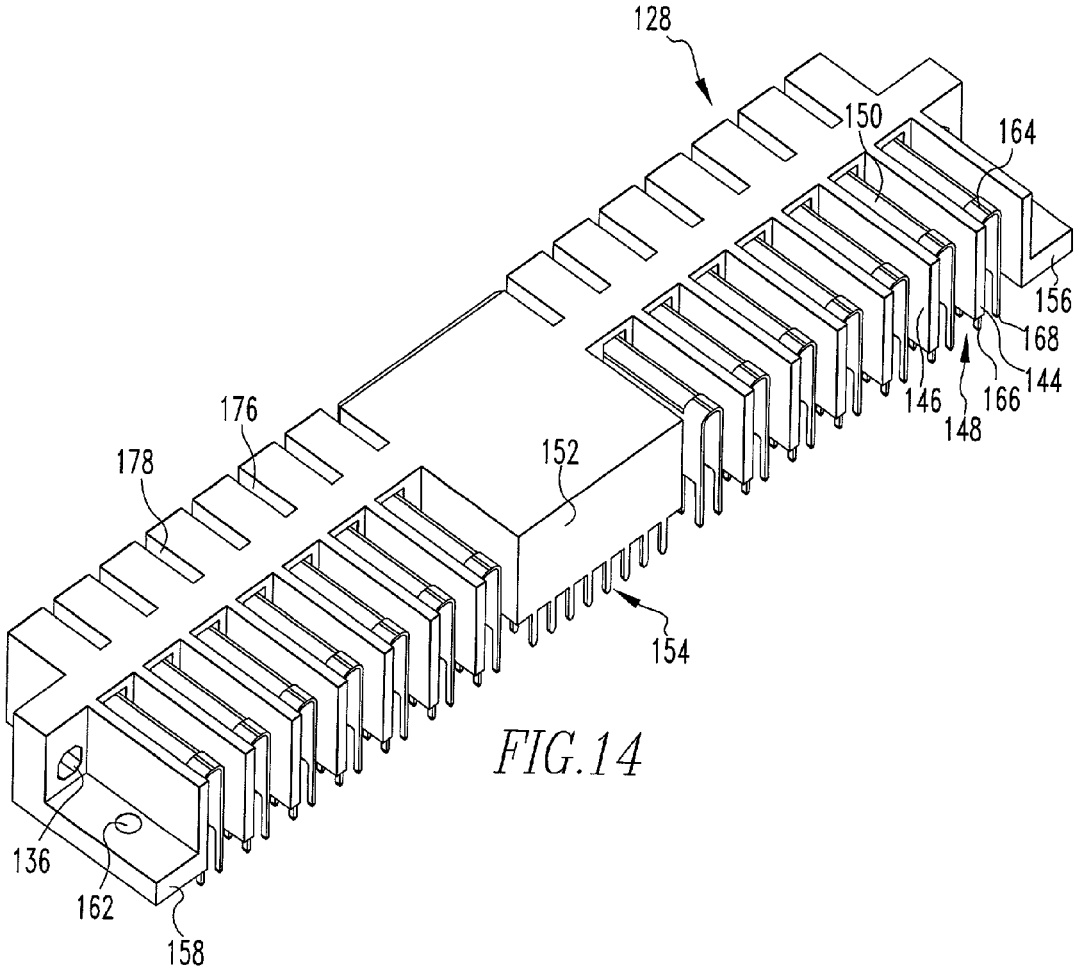
FIG. 14 is a top rear respective view other receptacle connector shown in FIG. 1.

Referring to FIGS. 3 and 4, receptacle contact 48 is shown. This receptacle contact has opposed, preferably planar and parallel side walls 50 and 52. These walls extend forwardly in a front projecting portion 54, that forms a medial plug receiving space 56. The distance between walls 50 and 52 at portion 54 is such that the projection 16 of the plug contact 10 is receivable in the plug contact receiving space 56, with the beams being resiliently deflected toward the center plane of contact 10. The deflection causes the beams to develop outwardly directed forces, thereby pressing the arcuate portions 24 against the inside surfaces of the portions 54 forming the receiving space 56, to develop suitable contact normal force. The side walls 50 and 52 also include, respectively, panels 58 and 60. Extending from panel 58 there are terminals 62, 64, 66 and 68. Extending from panel 60 there is terminal 70 as well as several other terminals (not shown). These terminals are-essentially the same as previously described terminals 32–40. The side walls 50 and 52 are joined together by generally arcuate bridging elements 72 and 74. Preferably, the receptacle contact is also stamped or otherwise formed in a single piece from a strip of phosphor bronze alloy or beryllium copper alloy.

FIGS. 5–9 illustrate a plug connector 75 having an insulative plug housing 76. The housing 76 includes a front side 78 having a plurality of power contact apertures 84 and 86. The front projection or mating portion 16 (FIGS. 1 and 2) of the plug contacts is disposed in apertures 84, 86. The plug contacts 10 are retained in the housing 76 by an interference fit between the contact and the housing. This is accomplished by having the dimension H (FIG. 2), the dimension between bottom edge of wall 12 and the top of bridging element 42, slightly greater than the dimension of the cavity in housing 76 that receives this portion of plug contact 10. The front side 78 may also include a signal pin array opening 88 for housing a signal pin array designated generally as numeral 90. The housing 76 also includes a number of rear vertical partitions, such as partitions 92 and 94, which form power contact retaining slots 96 for housing the plug contacts 98. The opposed medial vertical partitions 100 and 102 form between them a rear signal pin array space 104 for housing the rear portion 106 of the signal pins. The housing 76 also includes opposed rear mounting brackets 108 and 110 which have respectively mounting apertures 112 and 114. The plug contacts 10 have terminals 32, 34, 36, 38 and 40 extending below a bottom edge 80 of housing 76. The edge 80 forms a mounting interface, along which the housing is mounted to a printed circuit board or other structure on which the connector is mounted.

Referring to FIGS. 10–14, a receptacle connector 128 is shown. Receptacle 128 has an insulative housing 129 with a front side 130 including a plurality of silos 131 having contact openings, such as openings 136 and 138. The front side 130 forms a mating interface of the connector 128 for mating with plug connector 75. The silos 131 are configured and sized to be received in openings 84, 86 of connector 75. The front portions 54 (FIGS. 3–4) of the receptacle contacts are disposed within silos 131 and openings 134, 136 are sized and configured to receive the upper and lower sections 18 an 20 of plug contacts 10. The front side 130 has a signal pin receiving area 140 with signal pin receiving apertures. The housing 129 also has a plurality of rear partitions, such as partitions 144 and 146, which form contact retaining slots 148 for housing receptacle contacts 48. Signal pin housing 152 receives a signal receptacle contact array 154. The housing 129 also includes opposed rear mounting brackets 156 and 158 which have, respectively, mounting apertures 160 and 162. The receptacle contact terminals 62, 64, 66, 68 and 70 extend beneath surface 137, that forms the mounting interface of receptacle connector 128. The front side 130 of the housing 128 also has a plurality of vertical spaces 176 and 178, disposed between silos 131.

The receptacle contacts 48 are retained in housing 129 by an interference fit in essentially the same manner as previously described with respect to plug contacts 10. Retaining the contacts in this fashion allows substantial portions of the walls 12, 14 of the plug contact and walls 58, 60 of the receptacle contact to be spaced from surrounding parts of the respective housings 76 and 129. This leaves a substantial proportion of the surface area of both contacts (including the plug contacts), exposed to air, thereby enhancing heat dissipation capabilities, principally through convection. Such enhanced heat dissipation capabilities are desirable for power contacts.

Figure 15:
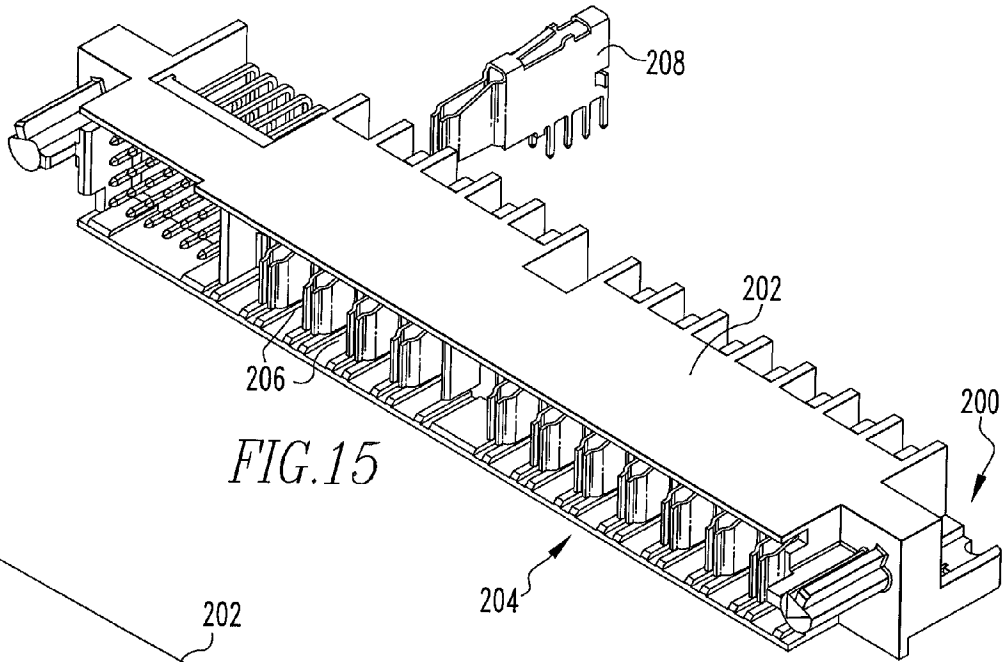
FIG. 15 is a front perspective view of a second embodiment of plug connector.

FIG. 15 shows another plug connector 200 embodying the invention. In this embodiment, the housing 202, preferably formed of a molded polymeric material, has a front face 204 that forms the mating interface of the connector. The face 204 includes a plurality of openings, such as openings 206, formed in a linear array.

Figure 16:
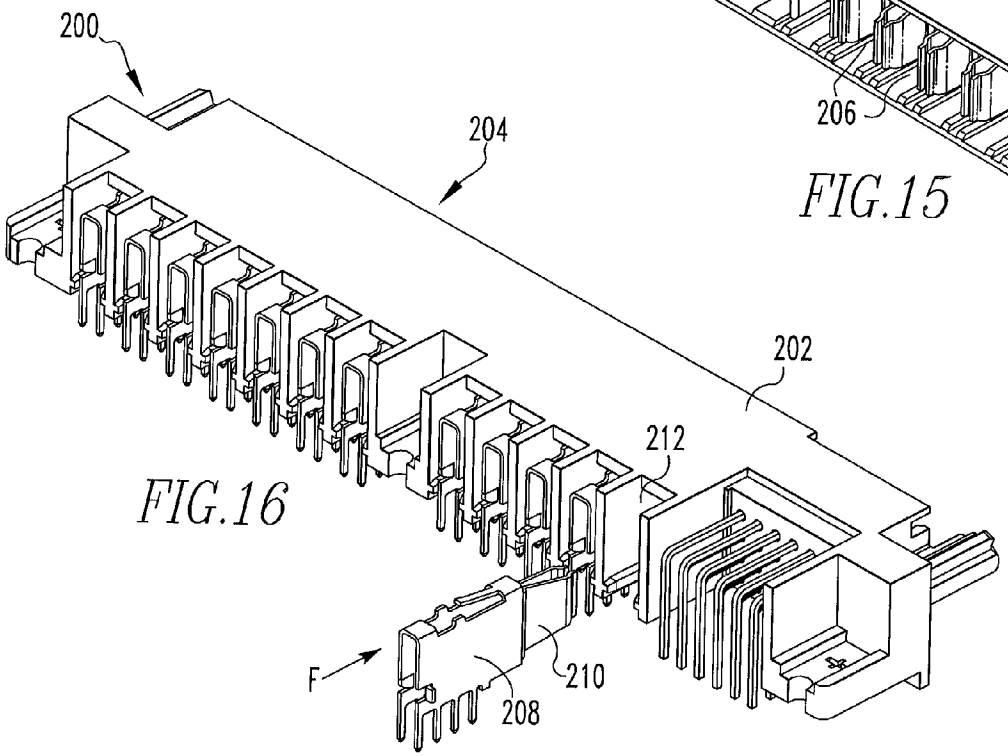
FIG. 16 is a rear perspective view of the plug connector of FIG. 15.

Referring to FIG. 16, the plug connector 200 includes a plurality of plug contacts 208. The contacts 208 are inserted from the rear of the housing into cavities 212 that extend from the rear of the housing toward the front of the housing. When the contacts 208 are fully inserted into the housing 202, the contact portions 210 with contacts 208 are disposed in the openings 206.

Figure 17:
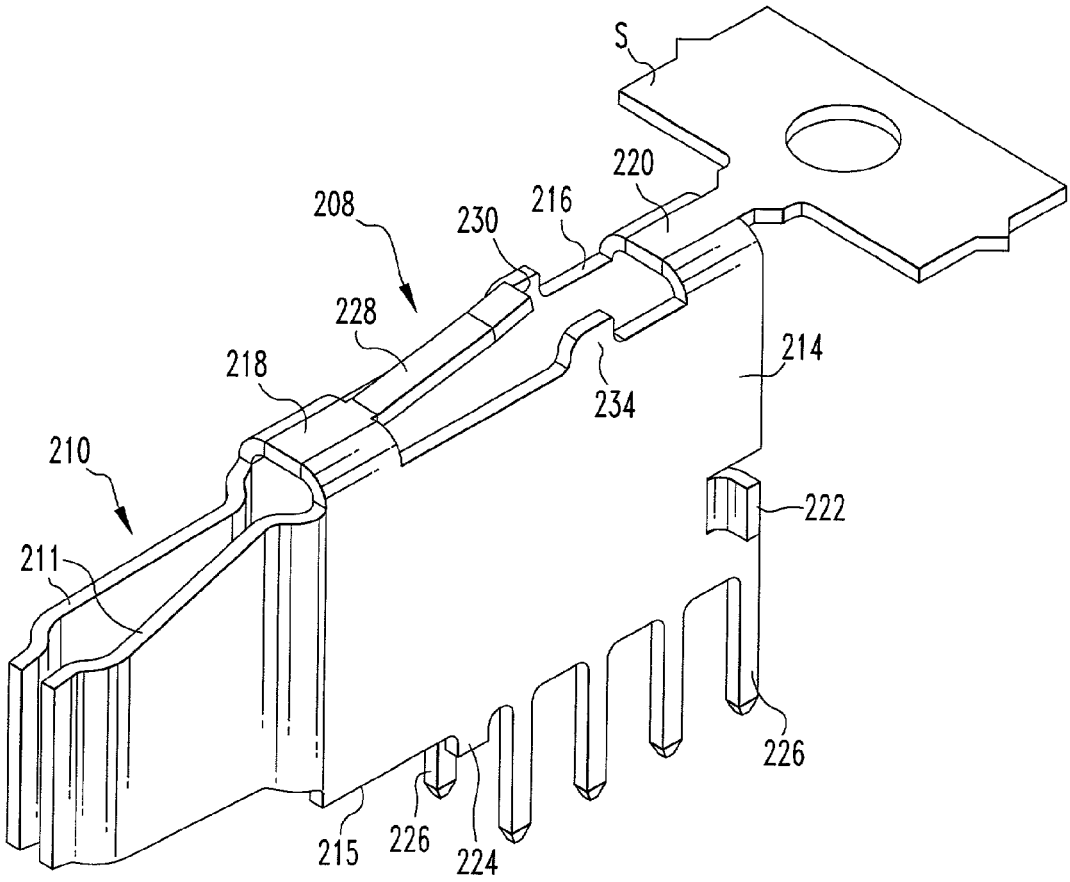
FIG. 17 is an isometric view of a plug contact used in the connector of FIG. 15, with the contact still attached to a portion of the strip material from which its formed.

Referring to FIG. 17, the plug contact 208 is similar in many respects to the plug contacts shown in FIG. 1. It includes spaced panel-like walls 214, 216 that preferably are planar and substantially parallel. The walls 214, 216 are joined by a front bridging element 218 and a rear bridging element 220. In this embodiment, the contact section 210 is formed by two opposed cantilevered beams 211 that extend from front edges of the walls 214, 216. Preferably, each wall includes a fixing tang 224 formed along a bottom of the edge of the wall. The walls 214, 216 also include lateral positioning elements, such as bent tangs 222, for centering the contact within cavities 212 in housing 202. Each wall also includes a positioning feature, such as raised lug 234.

The front bridging element 218 includes a rearwardly extending retention arm 228 that is cantilevered at its proximal end from the bridging element. Arm 228 includes a locating surface 230 at its distal end.

Terminals, such as through-hole pins 226, extend from the bottom edge of each wall 214, 216. The terminals 226 can be solder-to-board pins (as shown) or can comprise press fit or other types of terminals.

As can be seen from FIG. 17, the contacts 208 can be formed from sheet stock by stamping and forming the part from a strip of metrallic stock suitable for forming electrical contacts. The contacts 208 can be retained on a carrier strip S for gang insertion or separated from the strip prior to insertion into a housing.

Figure 18:
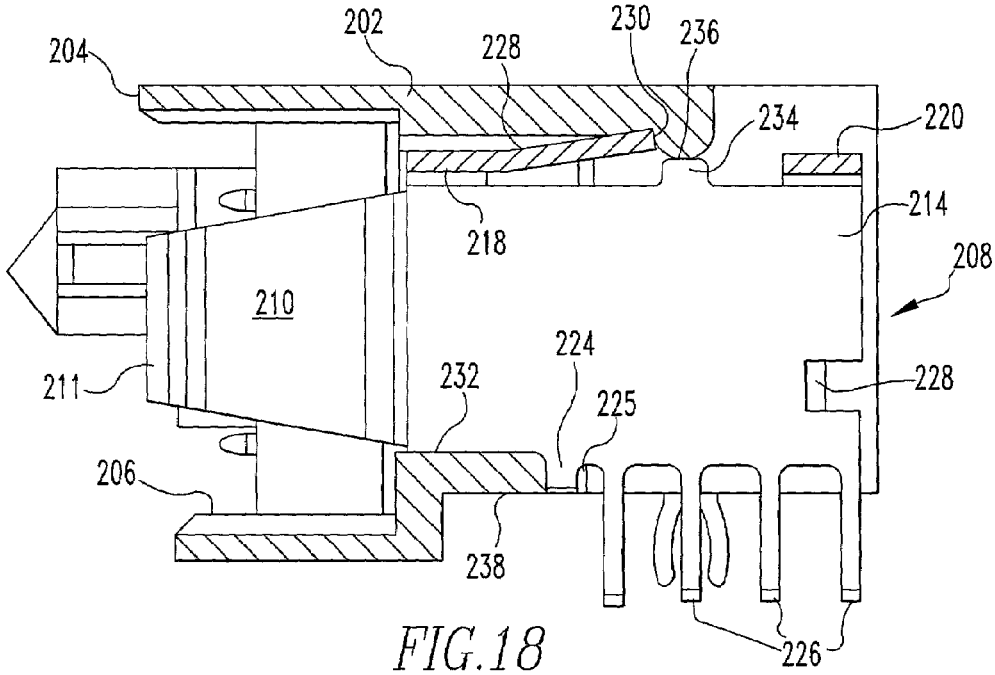
FIG. 18 is a side cross-sectional view of the plug connector of FIG. 15.

Referring to FIG. 18, the contact 208 is inserted into housing 202 from the rear into cavities 212 (FIG. 16). The contact 208 is located (in the vertical sense of FIG. 18) by engagement of the bottom edge 215 (FIG. 17) against surface 232 of the housing and by engagement of the top edges of the lugs 234 with the rib 236 in the upper part of the housing. The contact is maintained centered within the cavity 212 by the lateral tangs 222 that engage side walls of the cavity 212. The contact 208 is longitudinally locked in the housing (in the direction of contact mating) by means of the spring arm 228 that is deflected downwardly by the rib 236 of the housing during insertion and then resiles upwardly to position the stop surface 230 at its distal end against or near the forward surface of the rib 236.

The downwardly extending tang 24 is preferably received in a slot 225 in the housing, the width of the slot being substantially the same as the thickness of the tang 224. By capturing the tang 224 in the slot 225, deformation of the wall section, as might occur when the cantilever arms 211 of the contact section are urged toward each other, is limited to the portion of the walls 212, 216 disposed forwardly of the tangs 224. This enhances control of the contact normal forces generated by deflection of the cantilever arms 211.

As shown in FIG. 18, the terminals 226 extend below the bottom surface 238 of the housing 202, which bottom surface defines a mounting interface of the connector, along which it is mounted on a printed circuit board.

Figure 19:
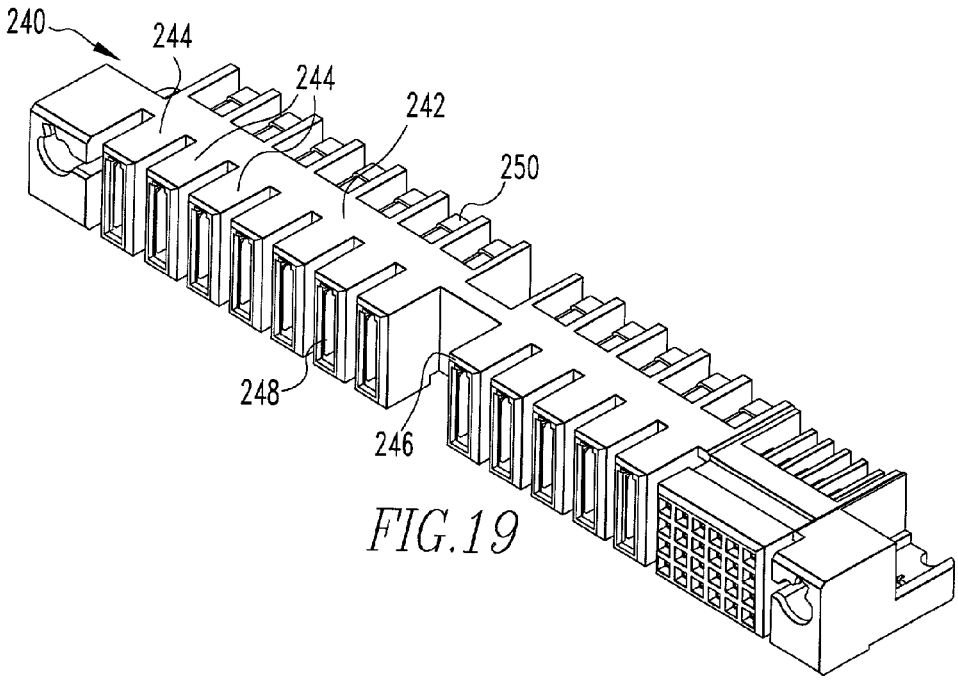
FIG. 19 is a front perspective view of a receptacle connector matable with the plug connector of FIG. 15.
Figure 20:
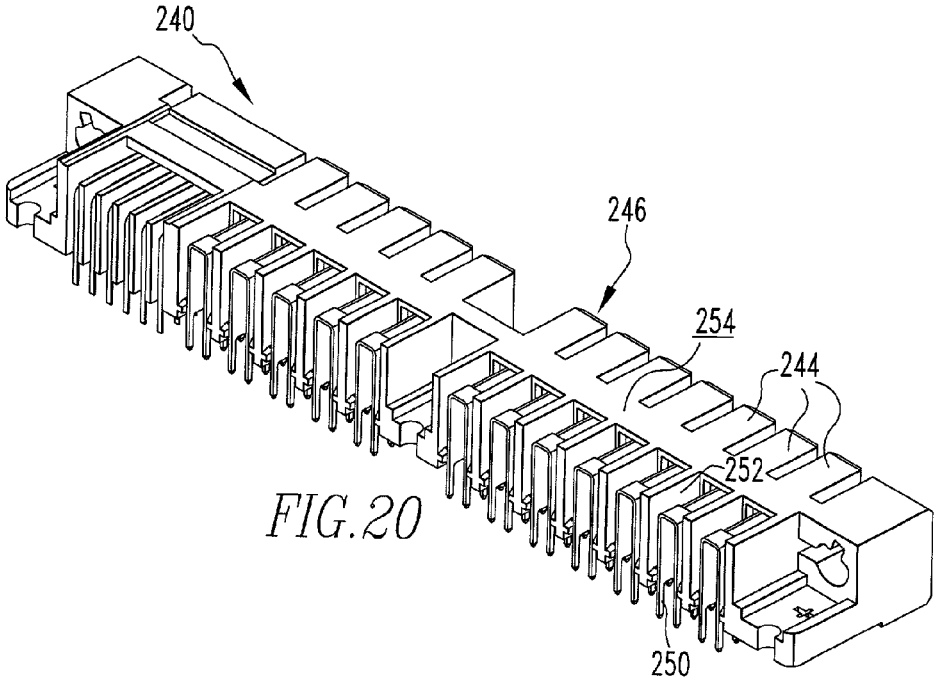
FIG. 20 is a rear perspective view of the receptacle connector shown in FIG. 19.

FIGS. 19 and 20 show a receptacle connector for mating with the plug connector illustrated in FIGS. 15–18. The receptacle connectors 240 include an insulative housing 242 that comprises an array of receptacle silos 244. The front surfaces 246 of the silos are substantially coplanar and form a mating interface of the connector. Each silo has an opening 248 for receiving the contact section 210 of the plug contacts 208 of the mating connector. The plurality of receptacle contacts 250 are mounted in the housing 242, preferably by insertion from the rear into cavities 252. As shown in FIG. 20, preferably the top wall 254 of the housing does not extend fully to the rear of the connector housing, thereby leaving substantial openings in the cavities 252.

Figure 21:
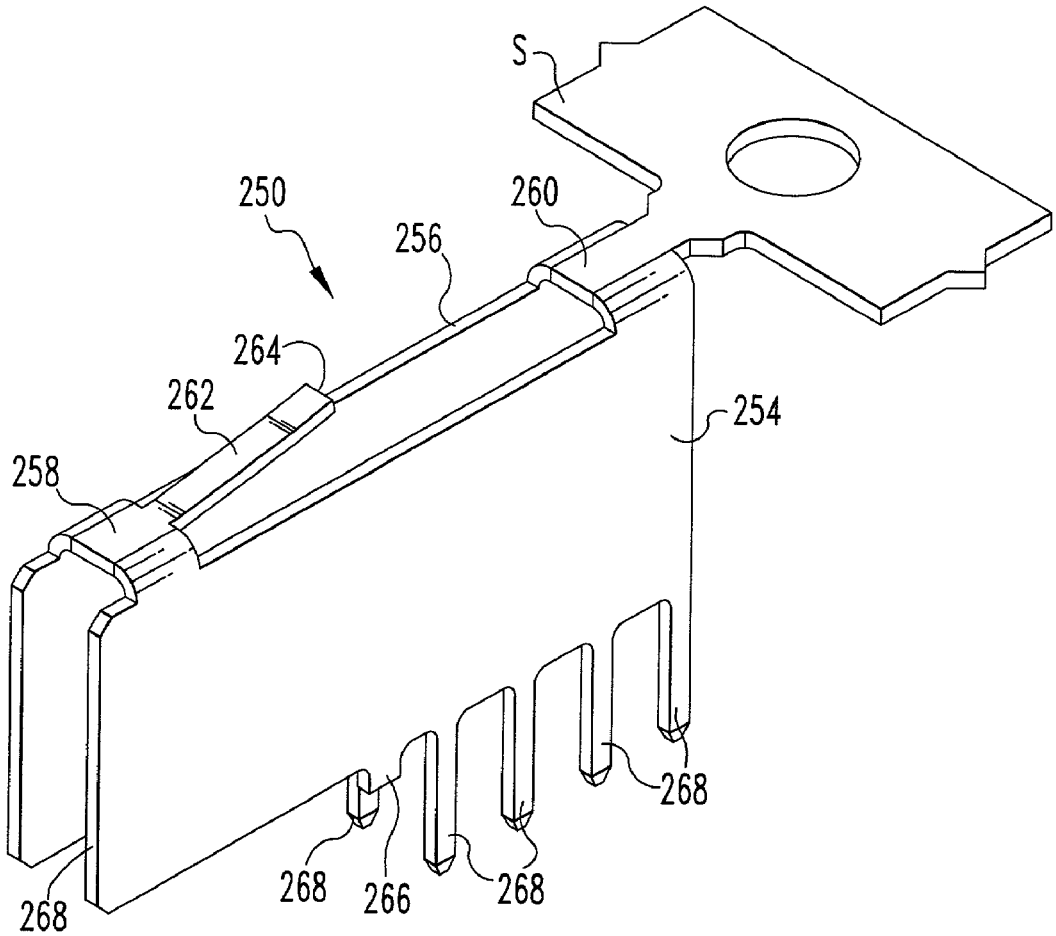
FIG. 21 is a isometric view of a receptacle contact used in the connector shown in FIG. 19, with the contact still attached to a portion of the metal strip from which it was formed.

The receptacle contact for receptacle connector 240 is illustrated in FIG. 21. The contact 250 is similar in basic form to the receptacle contact 48 illustrated in FIGS. 3 and 4. It includes two opposed walls 254, 256 that are preferably substantially planar and parallel, thereby forming between them a contact receiving and air flow space. The walls 254, 256 are joined by a front bridging element 258 and a rear bridging element 260. The front bridging element 258 includes a resilient latching arm that is cantilevered at its proximal end from bridging element 258 and carries at its distal end the latching or locking surface 264. As described previously, the receptacle contact 250 can be formed in a single, unitary piece, by stamping and forming the contact from a strip. As mentioned previously, the contacts can be inserted into the housing while attached to carrier strip S or after being separated therefrom.

Figure 22:
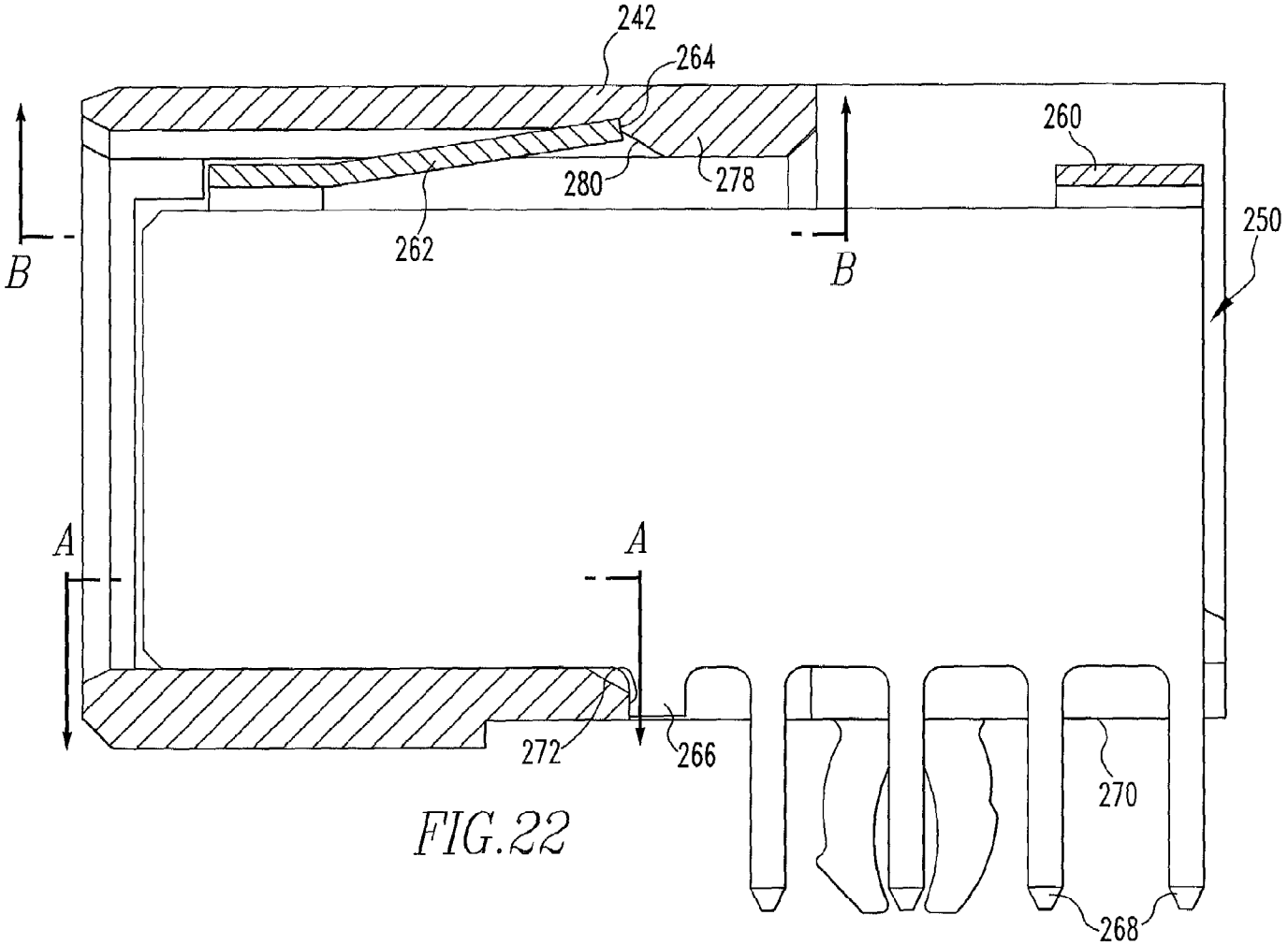
FIG. 22 is a side cross-sectional view of the receptacle connector shown in FIG. 19.

FIG. 22 is cross-sectional view showing a receptacle contact 250 inserted into housing 242. As shown, the locating tang 266 is positioned with its forward surface against the locating surface 272 in the bottom wall of the housing 242, thereby positioning the contact in its forward-most position. As the contact is inserted in the housing, the latching arm 262 is caused to resile downwardly when it engages the latching portion 278 of the housing. As the latching arm 262 resiles upwardly after it passes the latching section 278, the locking surface 264 engages a raised rib 280 (FIG. 22*b*) thereby locking the contact against rearward movement with respect to the housing. The terminals 268 extend beyond the surface 270 that forms the mounting interface of connector 240.

Figure 22A:
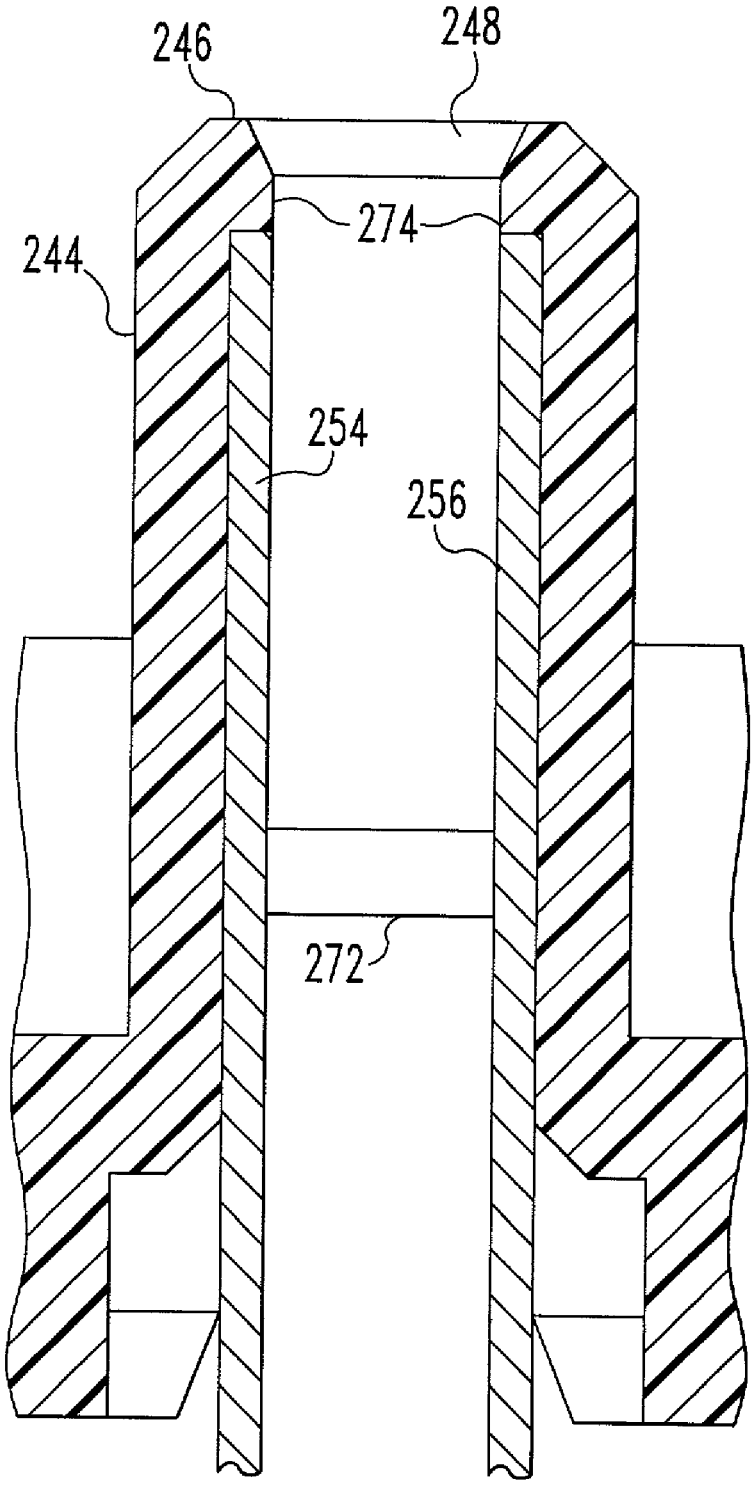
FIG. 22*a* is a partial cross-sectional view taken along line AA of FIG. 22.
Figure 22B:
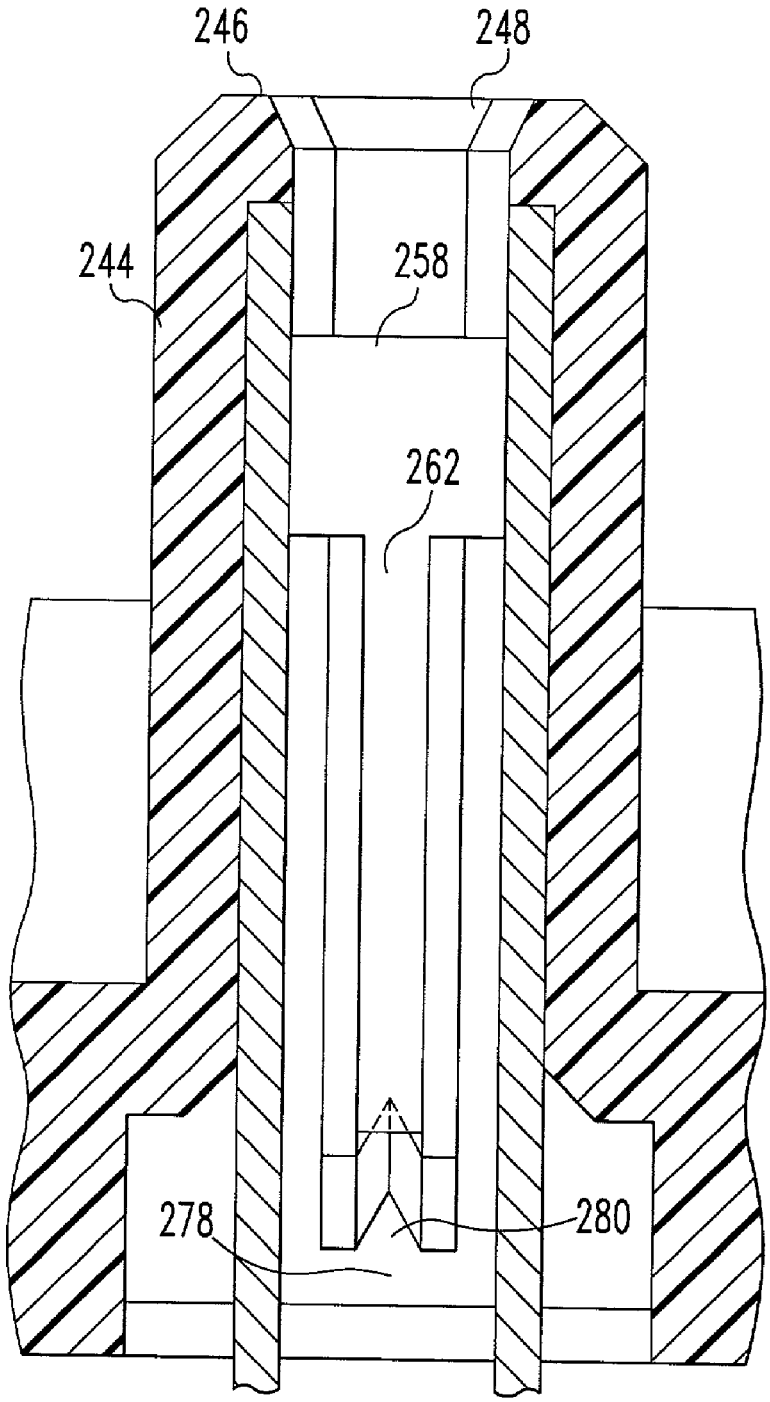
FIG. 22*b* is a partial cross-sectional view taken along line BB of FIG. 22.

As illustrated in FIGS. 22*a* and 22*b*, the forward portions of the walls 254, 256 are disposed along inside side walls of the silos 44. At the forward surface 246 of each silo, a plug contact receiving opening 248 is formed. The opening includes a pair of lips 274 that are coplanar with or extend just slightly beyond the inside surfaces of the walls 254, 256. This arrangement provides the benefit of lowered initial insertion forces when the connectors 200 and 240 are mated. As the silos 244 enter the openings 206 (FIG. 15), the contact sections 210 formed by the cantilevered arms 211 first engage the surfaces of lips 274. Because the coefficient of friction between the cantilevered arms 22 and the plastic lips 274 is relatively lower than the coefficient friction between the cantilevered arms and the metal walls 254,256, initial insertion force is minimized.

Figure 23:
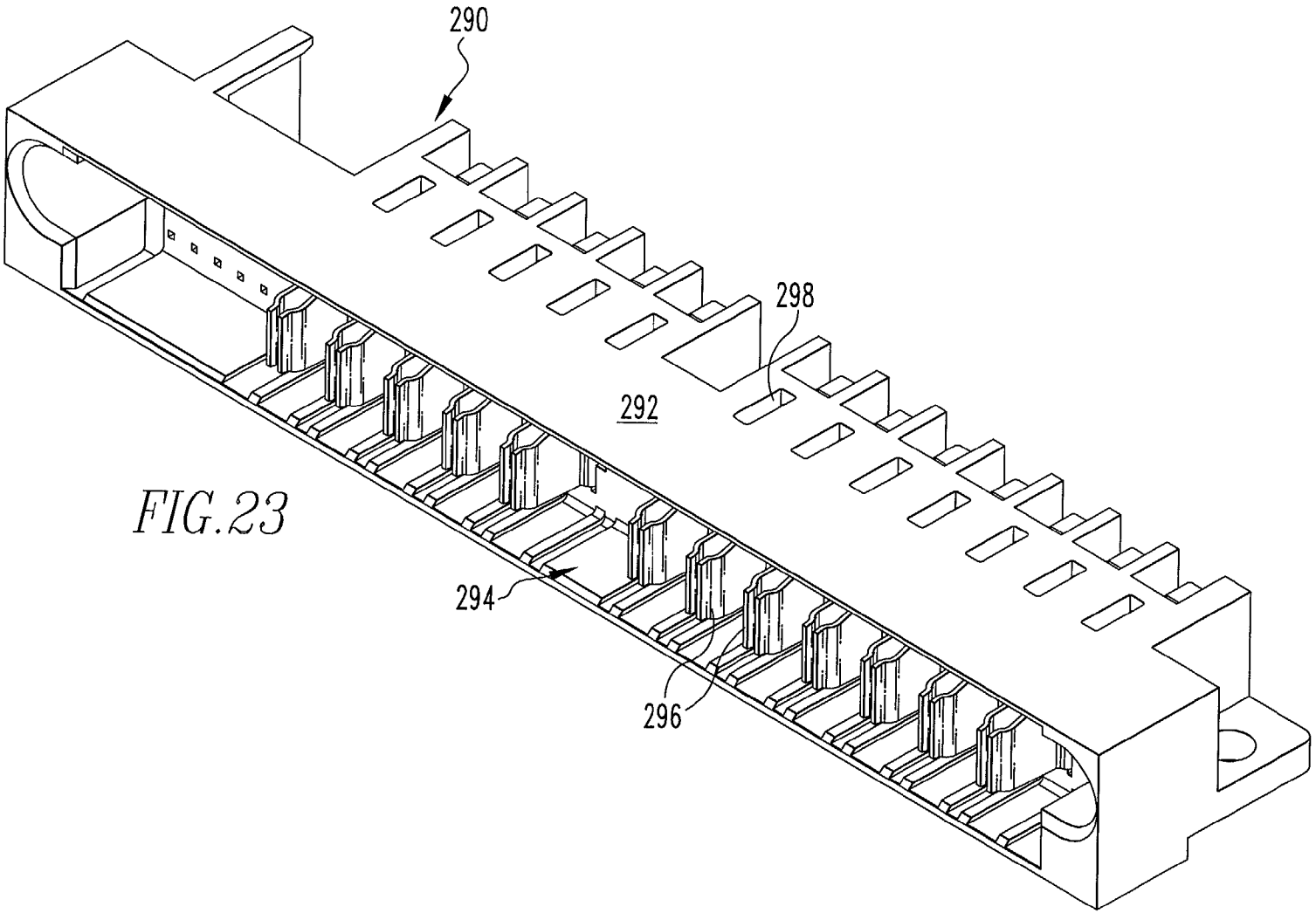
FIG. 23 is a front perspective view of a third embodiment of plug connector.
Figure 23A:
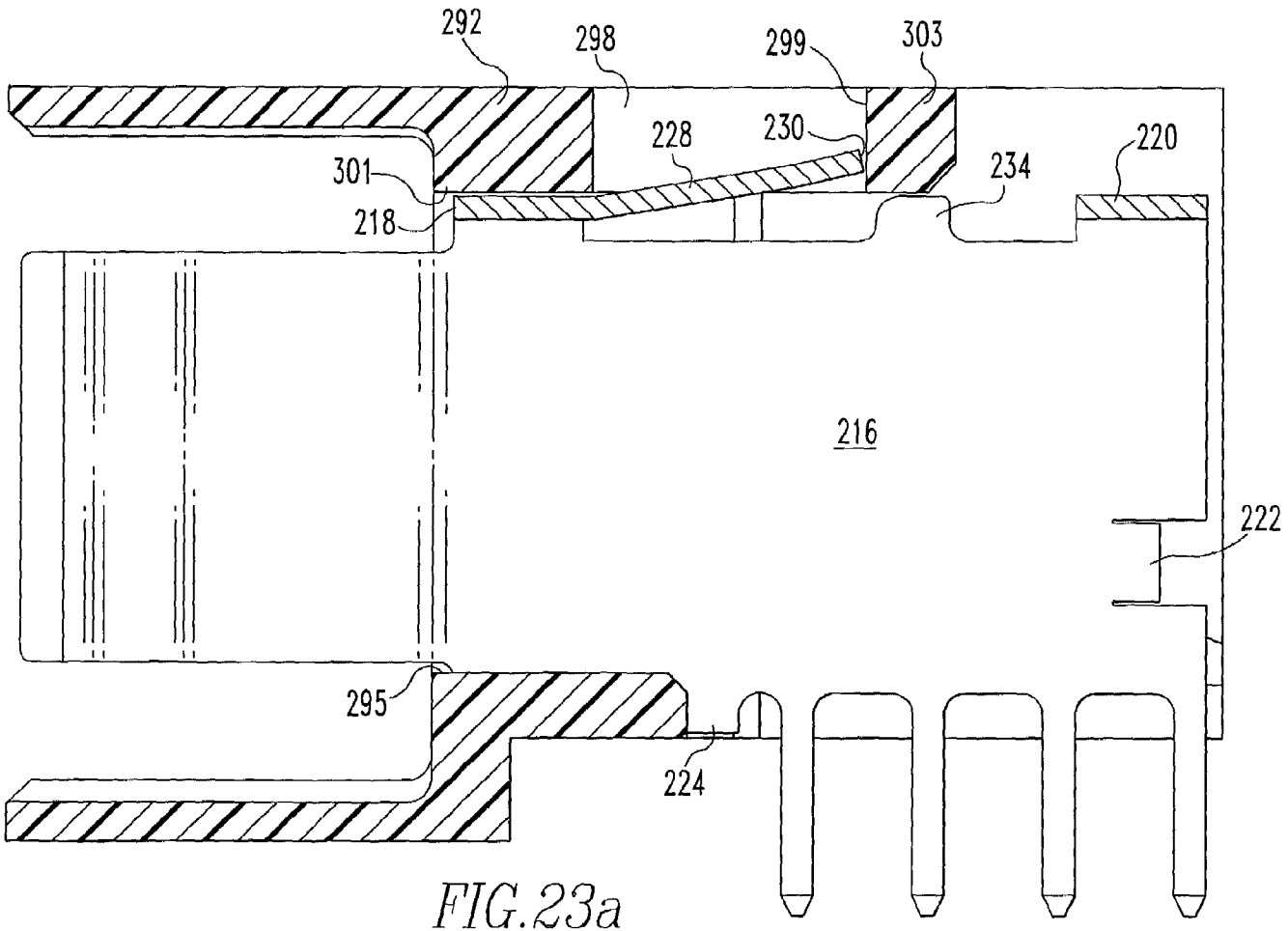
FIG. 23*a* is a cross-sectional view of an alternative arrangement for securing a contact in a housing.

FIG. 23 shows another embodiment of plug connector 290. In this embodiment, the housing 292 has a single front opening 294 in which the contact sections 296 of the plug contacts are disposed. The housing also includes a plurality of openings 298 in the top wall of the housing. As shown in FIG. 23*a*, the bridging element 218 and locating lug 234 engage the top surface 301 of the contact receiving cavity and the bottom surface 295 of the cavity in an interference fit. The arm 228 deflects downwardly as the contact is inserted into the housing and the arm engages portion 303. When the arm 228 clears portion 303, the arm resiles upwardly to locate stop surface 230 adjacent surface 299, thereby locking the contact against retraction. The openings 298 are positioned above the latching arms 228 (FIG. 18), to allow the arm 228 to be moved from a retention position and the contacts to be withdrawn from the housing. This can be accomplished by insertion of a suitable tool (not shown) through opening 298. Openings 298 can also provide air flow passages for enhancing heat dissipation.

Figure 24:
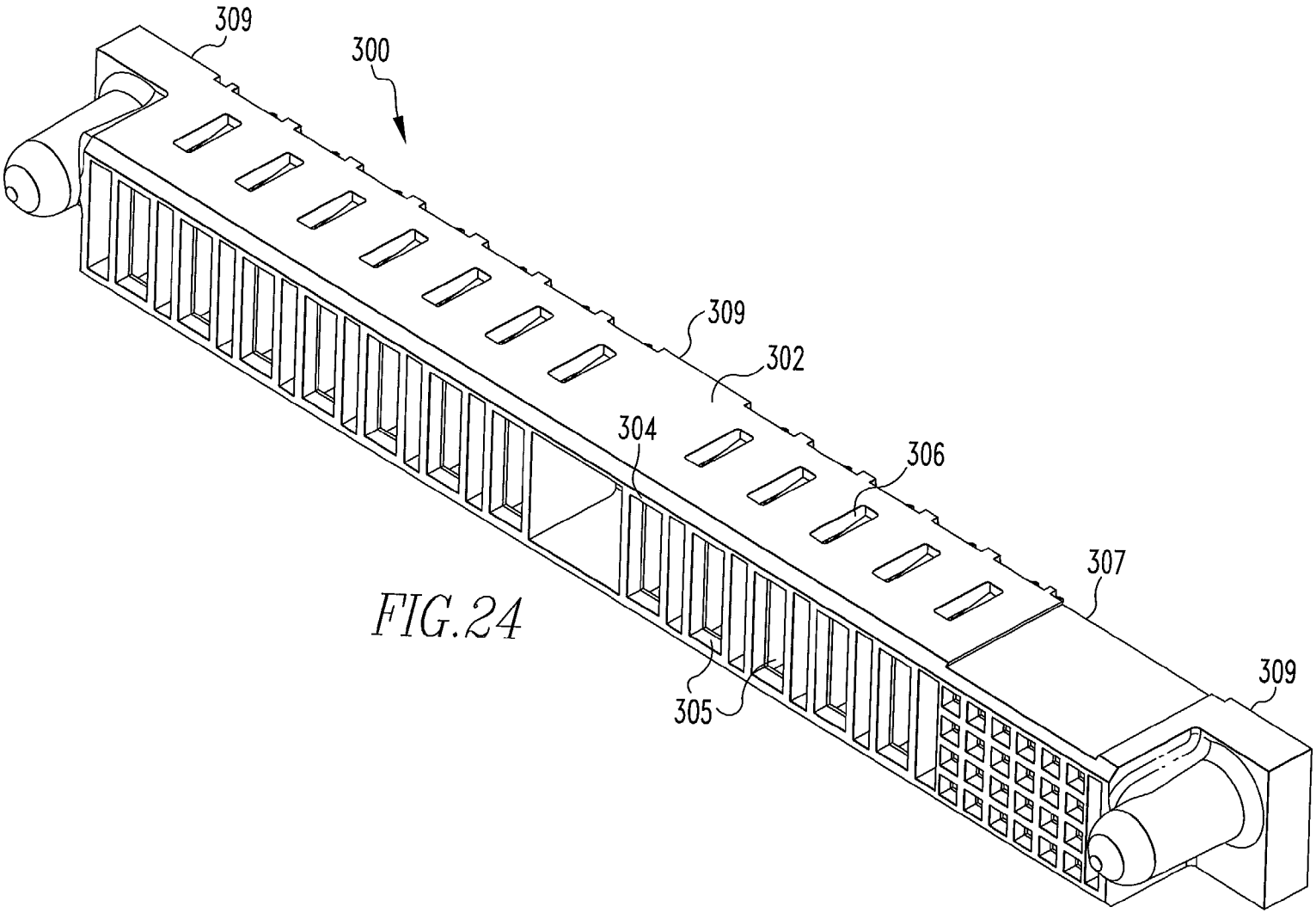
FIG. 24 is a front perspective view of a receptacle connector adapted to mate with the plug connector with FIG. 23.

FIG. 24 illustrates a receptacle connector 300 adapted to mate with plug connector 290. The receptacle connector 230 employs a housing 302 having a continuous front face 304, rather than a plurality of silos as in previous embodiments. The entire front face 304 of the connector 300 is received in opening 294, with the contact sections 296 inserted into openings 305 of face 304. Openings 306 in the top wall of the housing allow access to the latching arms of the receptacle contacts (not shown) as described in the previous embodiment.

Figure 25:
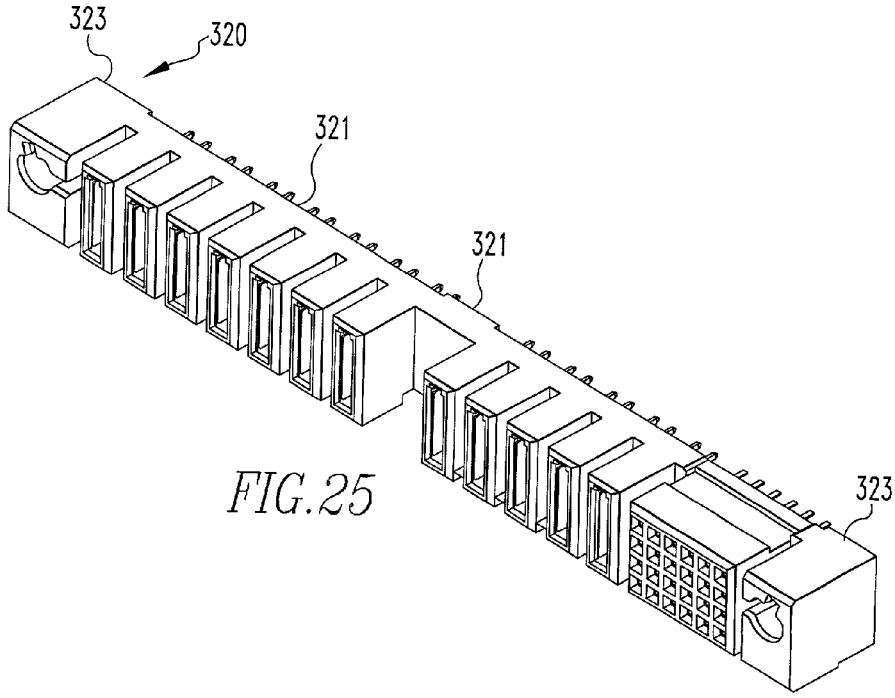
FIG. 25 is a front elevational view of another embodiment of receptacle connector.
Figure 26:
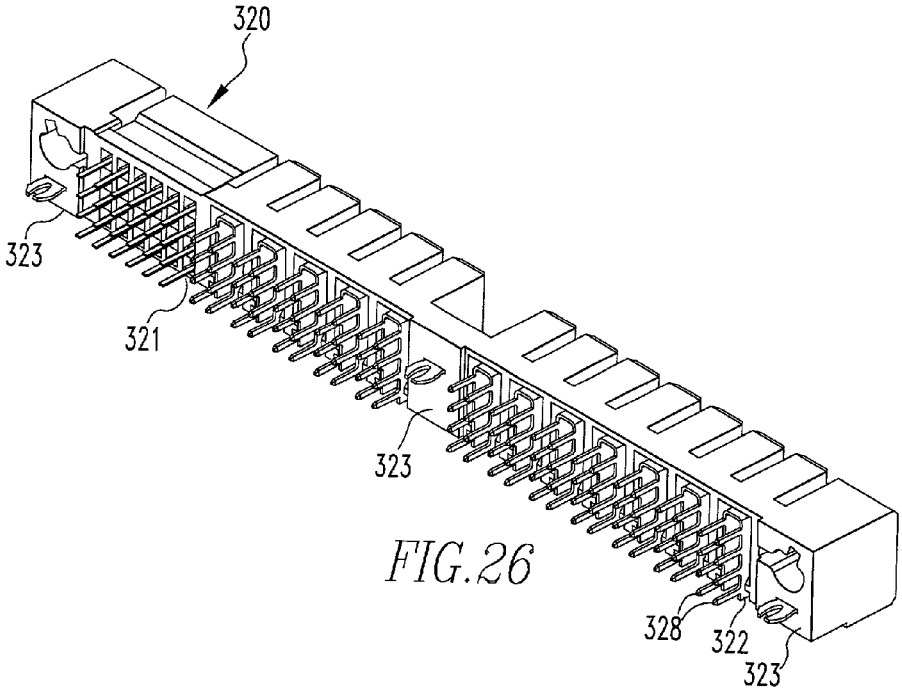
FIG. 26 is a bottom respective view of the connector shown in FIG. 25.

The embodiment of FIG. 24 and also the embodiment of FIGS. 25 and 26 are meant for use in a vertical configuration, as opposed to a right angle configuration. The housing 302 of connector 300 (FIG. 24) has a bottom side 307. Preferably, a plurality of standoff surfaces 309 form a mounting interface, along which the housing is mounted on a substrate, such as a printed circuit board. Similarly, the housing of connector 320 has a bottom surface 321 with standoffs 323. Appropriate receptacle contacts 322 (FIG. 7) are inserted into the housings of connectors 300 and 320 from the bottom sides 307 and 321, respectively.

Figure 27:
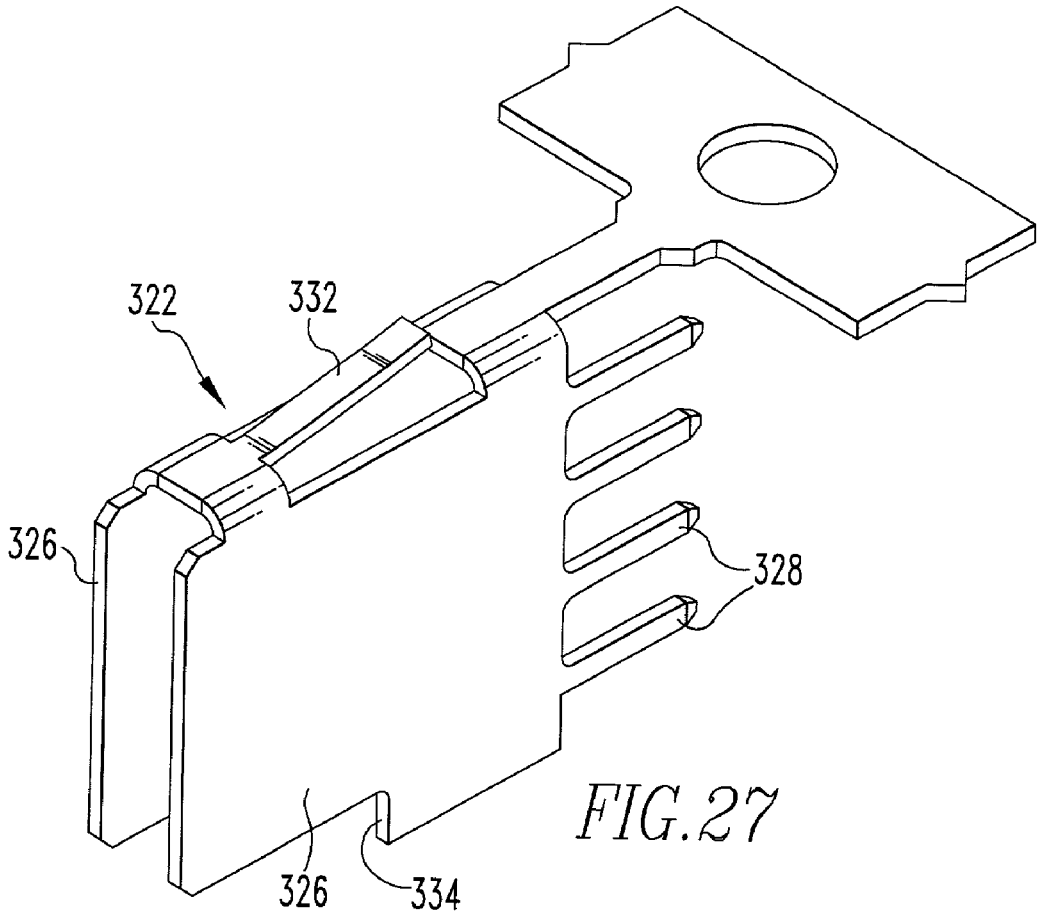
FIG. 27 is an isometric view of a receptacle contact used in the connectors illustrated in the FIGS. 25 and 26.
Figure 28:
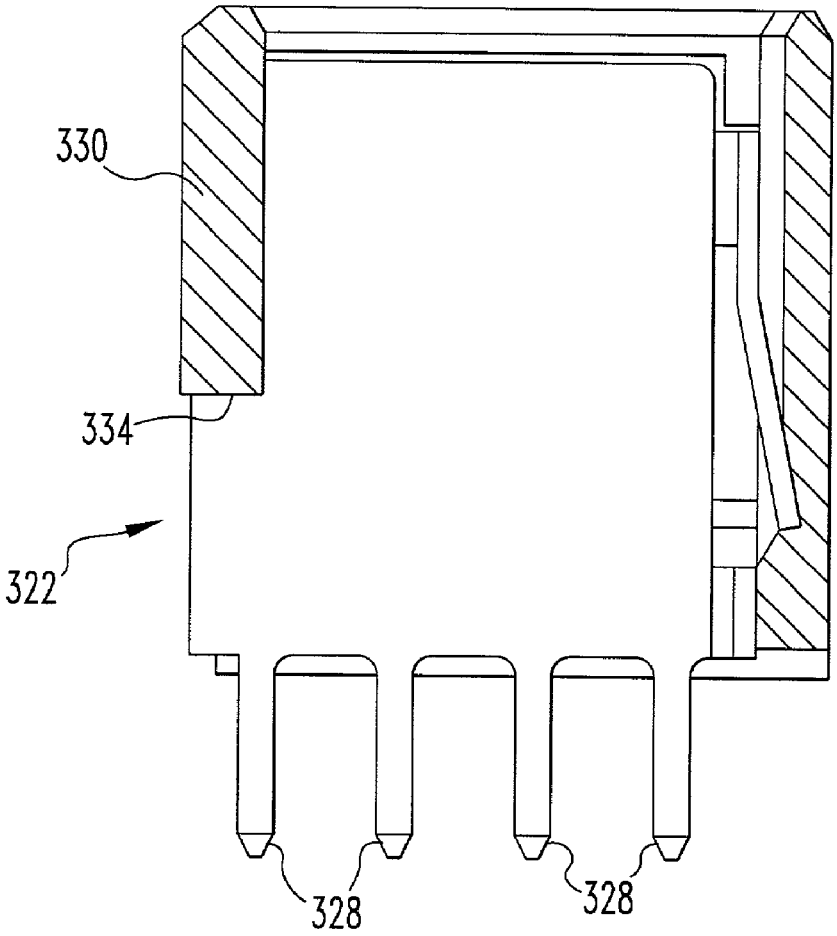
FIG. 28 is a cross-sectional view of a connector as shown in FIG. 25.

FIG. 27 shows a receptacle contact 322 comprising a pair of preferably planar parallel walls 324, 326 that form between them a contact receiving space for receiving plug contacts of the type previously described. This contact has terminals 328 extending from a rear edge of each of the walls. As shown in FIG. 28, the contact 322 is received in housing 330 in a manner similar to that previously described, wherein the resilient latching arm locks the contact against downward (in the sense of FIG. 28) movement, while a locating surface 334 locates the contact in the opposite direction with respect to the housing. The terminals 328 extend beyond the plane of the mounting interface of the connector housing for insertion into through holes in the printed circuit board.

Figure 29:
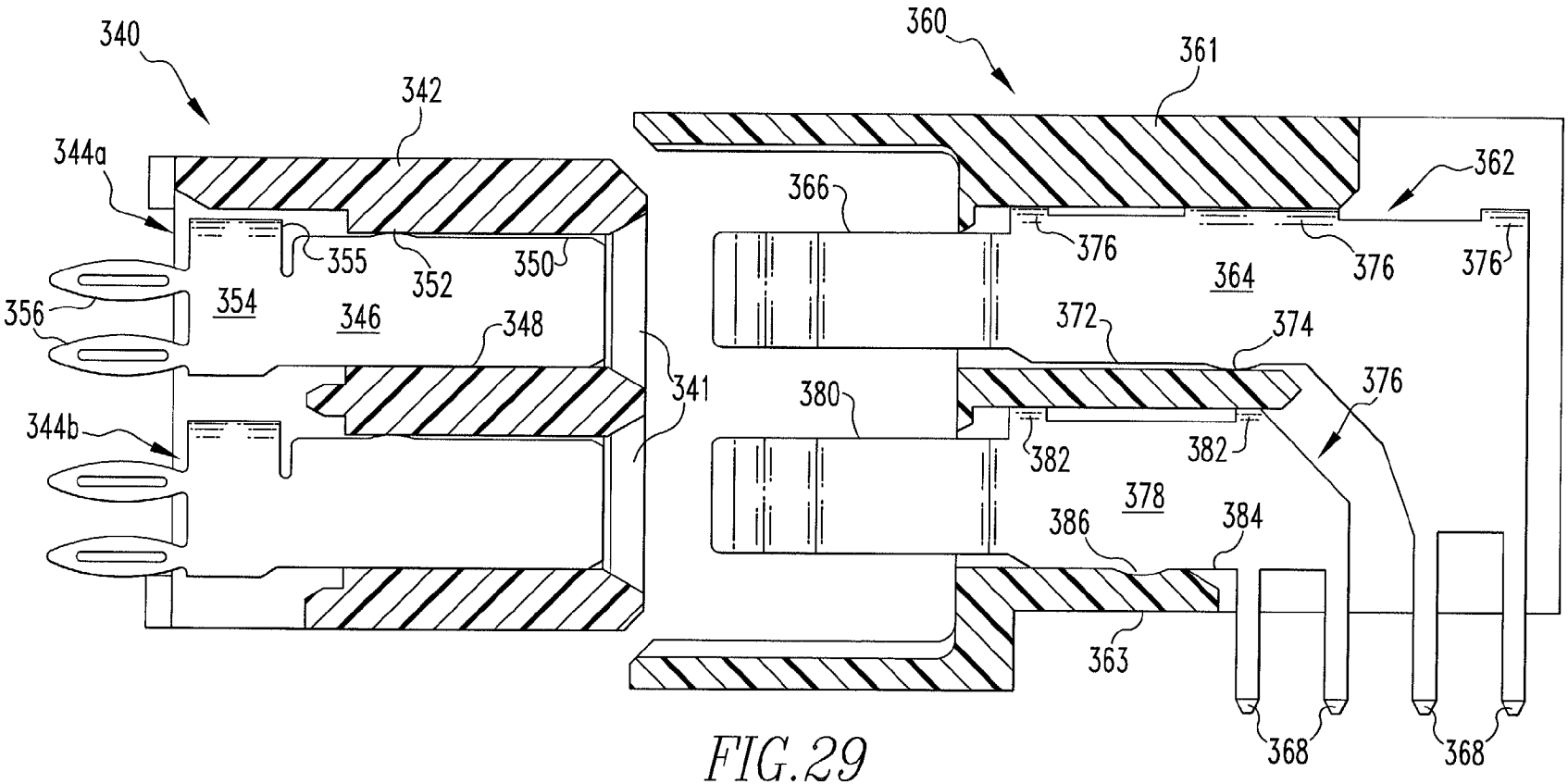
FIG. 29 is a cross-sectional view of an embodiment employing stacked contacts in the plug and receptacle connectors.

FIG. 29 shows an embodiment employing two sets of contacts at each location, in a stacked configuration. The receptacle connector 340 has a housing formed of insulative material. The housing 342 includes a mating interface having a plurality of openings 341. Each of the openings 341 open into cavities in housing, which cavities receive substantially identical receptacle contacts 344*a* and 344*b*. Each of the contacts 344*a* and 344*b* is similar in general construction to the receptacle contacts previously described, there being a pair of such contacts in each cavity, generally aligned along the side walls thereof, to form a gap between generally parallel plate sections 346. The plate sections 346 have two opposed edges 348 and 350, one of which carries a retention feature, such as interference bump 352. The receptacle contact sections 356 are retained in the housing by suitable means, such as an interference fit created by the bump 352. Each contact section 356 includes a generally coplanar wall section 354. The wall sections 354 are joined by a bridge section 355. Suitable terminals, such as press fit terminals 356 extend from an edge of the wall section 354, in the case where the connector 340 is to be used in a vertical configuration.

The mating plug connector 360 includes a molded polymeric body 361 that receives a pair of plug contacts, such as upper plug contact 362 and the lower plug contact 376. These plug contacts are configured generally in the manner previously described, namely, being formed of a pair of spaced wall sections 364 and 368 respectively joined by bridging elements and carrying opposed contact beams 366 and 380 to engage the spaced receptacle plates 346. The plug contact 362 includes a single, relatively long, or several, relatively short, bridging elements 376 that join two opposed plates 364. The bottom edge 372 of each of the plates 364 includes retention structure, such as an interference bump 374. The plug contact 362 is retained in its cavity within housing 361 by an interference fit between the bridging elements 376 and the interference bump 374, although it is contemplated that other retention mechanisms could be utilized. Similarly, lower plug contacts 376 comprise a pair of coplanar wall or panel members 378 joined by one or more bridging elements 382. The lower edge 384 of each wall 378 includes an interference bump 386, that functions to create an interference fit, as previously described. Suitable terminals 368 and 380 extend from each of the panels 364 and 368, beyond the mounting interface 363 of the housing 361, for associating each of the contacts 362 and 376 with electrical tracks on the printed circuit board on which the plug 360 is to be mounted.

The previously described receptacle and plug contacts may be plated or otherwise coated with corrosion resistant materials. Also, the plug contact beams may be bowed slightly in the transverse direction to enhance engagement with the contact receiving surfaces of the receptacle contacts.

The "dual-mass" construction of both receptacle and blade contacts, employing opposing, relatively thin walls, allows for greater heat dissipation as compared with prior "singular-mass" designs. In comparison with "singular mass" connectors of similar size and power handling capabilities, the "dual mass" connectors, as disclosed have approximately two times the surface area. The enhanced current flow and heat dissipation properties result from the contacts having greater surface area available for convection heat flow, especially through the center of the mated contacts. Because the plug contacts have an open configuration, heat loss by convection can occur from interior surfaces by passage of air in the gap between these surfaces.

The contacts also contain outwardly directed, mutually opposing receptacle beams and dual, peripherally located, mating blades, in a configuration which can allow for flexibility in modifying contact normal forces by adjustment the contact connector geometry. This can be accomplished by modifying the bridging elements to change bend radius, angle, or separation of the walls of the contacts. Such modifications cannot be accomplished with conventional singular-mass beam/blade configurations wherein the opposing receptacle contacts are inwardly directed, and the mating blade is located in the center of said beams.

Such dual, opposing, planar contact construction also allows for easier inclusion of additional printed circuit board attachment terminals with more separation between terminals, compared to an equivalent "singular-mass" bulk designs. The use of relatively larger plates in the plug and receptacle contacts gives this opportunity for providing a plurality of circuit board terminals on each contact part. These lessens constriction of current flow to the printed circuit board, thereby lowering resistance and lessening heat generation.

The use of a compliant plug mating section allows the receptacle contacts to be placed in a protected position within the molded polymeric housing for safety purposes. This feature is of further benefit because it allows minimization of amount of polymeric material used in making the housing. This lowers material costs and enhances heat dissipation. Also, by retaining the contacts in the housing in the manner suggested, thick wall structures can be avoided and thin, fin like structures can be utilized, all of which enhances heat dissipation from the connectors. Additionally, first-make, last break functionality can be incorporated easily into disclosed connector system by modifying the length of the mating portion of the plug contacts or by changing the length of the plug-receiving portion of the receptacle contacts.

The arch connection structure between opposing rectangular contact sections also allows for attachment of retention means, such as a resilient arm structure as shown in one of the current embodiments, in a manner that does not limit current flow or hinder contact heat dissipation capability.

It will also be appreciated that the plug and receptacle contacts may be manufactured from closely similar or identical blanks thereby minimizing tooling requirements.

Further, the plug or receptacle connectors can easily be associated with cables, by means of paddle boards.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. An electrical connector for power applications, the connector comprising:

a) an insulative housing;

b) a cavity disposed in said insulative housing, the cavity defined by a first wall and two spaced apart housing walls that each extend from the first wall; and c) a power contact disposed in said cavity, said power contact comprising: a pair of opposed contact walls defined by a first planar panel, a second planar panel a bridging element adjoining the first and second planar panels, a medial space between the first planar panel and the second planar panel; a first compressible beam that adjoins the first planar panel and extends in a direction generally parallel to one of said two spaced apart housing walls; a second compressible beam that adjoins the second planar panel and extends in a direction generally parallel to one of said two spaced apart housing walls, the first and second compressible beams extending outwardly away from each other and inwardly toward each other; and separated contact terminals that extend from the first planar panel and the second planar panel in a direction perpendicular to the first compressible beam and the second compressible beam and generally parallel to one of said two spaced apart housing walls, wherein at least one portion of the first planar panel and the second planar panel is spaced from an adjacent one of said housing walls such that heat dissipation can also occur from an exterior surface of the power contact.

2. The electrical connector of claim 1, wherein a heat dissipation channel defined by one of the first and second planar panels and the adjacent one of the housing walls is fluidly connected to a heat dissipation through-hole defined by the housing.

3. The electrical connector of claim 1, further comprising a lateral positioning element for spacing one of the first and second planar panels from one of the two spaced apart housing walls.

4. The electrical connector of claim 3, wherein said lateral positioning element extends from one of said two spaced apart walls.

5. A connector system, comprising:

(A) a connector, comprising:

a) an insulative housing;

b) a plurality of cavities disposed in said insulative housing defined by a series of housing walls; and c) a power contact disposed in each one of said plurality of cavities, said power contact comprising a pair of opposed contact walls defined by a first planar panel, a second planar panel, a medial space between the first planar panel and the second planar panel, a first flexible beam extending from the first planar panel, and a second flexible beam extending from the second planar panel, the first and second flexible beams extending outwardly away from each other and inwardly toward each other;

wherein heat dissipation can occur from interior contact surfaces by passage of air in the medial space; and wherein at least one portion of the first planar panel and the second planar panel is spaced from an adjacent housing wall such that heat dissipation can also occur from an exterior contact surface; and (B) a mating connector, comprising:

a) an insulative housing;

b) a plurality of cavities disposed in said insulative housing of the mating connector, the cavities being defined by a series of housing walls; and c) a plurality of receptacle contacts for receiving the first and second flexible beams of respective ones of the power contacts, each of the receptacle contacts being disposed in a respective one of said plurality of cavities disposed in said insulative housing of the mating connector, each of said receptacle contacts comprising a pair of opposed contact walls defined by a first planar panel, a second planar panel, and a medial space between the first planar panel and the second planar panel of the receptacle contact, each of said receptacle contacts further comprising a bridging element adjoining the first and second planar panels of the receptacle contact;

wherein heat dissipation can occur from interior contact surfaces of the receptacle contacts by passage of air in the medial spaces of the receptacle contacts; and wherein at least one portion of the first planar panel and the second planar panel of each of the receptacle contacts is spaced from an adjacent housing wall of the mating connector such that heat dissipation can also occur from an exterior contact surface of the receptacle contact.

* * * * *